United States Patent [19]

Kakizaki

[11] Patent Number: 4,981,066

[45] Date of Patent: Jan. 1, 1991

[54] ELECTRONIC MUSICAL INSTRUMENT CAPABLE OF EDITING CHORD PERFORMANCE STYLE

[75] Inventor: Tadasu Kakizaki, Shizuoka, Japan

[73] Assignee: Yamaha Corporation, Hamamatsu, Japan

[21] Appl. No.: 406,357

[22] Filed: Sep. 12, 1989

Related U.S. Application Data

[62] Division of Ser. No. 210,926, Jun. 24, 1988, Pat. No. 4,881,440.

[30] Foreign Application Priority Data

Jun. 26, 1987 [JP] Japan ..... 62-160754
Jun. 26, 1987 [JP] Japan ..... 62-160755

[51] Int. Cl.[5] ..... G10H 1/38; G10H 7/00

[52] U.S. Cl. ..... 84/613; 84/650; 84/DIG. 22

[58] Field of Search ..... 84/609–614, 84/639–643, 601, 602, DIG.22

[56] References Cited

U.S. PATENT DOCUMENTS 4,615,024 9/1986 Usui .
4,619,176 10/1986 Isii ..... 84/613 X
4,622,877 11/1986 Strong .
4,682,526 7/1987 Hall et al. .
4,704,682 11/1987 Clynes .
4,719,834 1/1987 Hall et al. .
4,763,257 8/1988 Clynes .
4,881,440 11/1989 Kakizaki .

FOREIGN PATENT DOCUMENTS 58-211191 12/1983 Japan .

*Primary Examiner*—Stanley J. Witkowski
*Attorney, Agent, or Firm*—Burns, Doane, Swecker & Mathis

[57] ABSTRACT

There is disclosed an electronic keyboard system capable of producing musical tones on the basis of a sequence of pieces of musical data information and comprising: (a) memory for storing the pieces of musical data information grouped by time durations with respect to a beginning of a performance; (b) modification range defining portion for specifying a head position and a terminational position in the pieces of musical data information; (c) setting portion for establishing a variation; (d) modifying portion for modifying each first musical data information between the head position and the terminational position on the basis of the variation.

5 Claims, 18 Drawing Sheets

ELECTRONIC MUSICAL INSTRUMENT CAPABLE OF EDITING CHORD PERFORMANCE STYLE

This application is a division of U.S. Application Ser. No. 210,926 filed June 24, 1988, now U.S. Pat. No. 4,881,440.

FIELD OF THE INVENTION

This invention relates to an electronic musical instrument and, more particularly, to an editor incorporated in the electronic musical instrument such as, for example, an electronic keyboard system for modification of a piece of recorded music information.

BACKGROUND OF THE INVENTION

An example of the electronic musical instrument is disclosed in Japanese Patent Application laid-open (Kokai) No. 58-211191. This prior-art electronic musical instrument has not only an recording mode of operation but also an editing mode of operation. In the recording mode of operation, a sequence of pieces of musical data information are produced in accordance with keying-in operations on a keyboard and memorized in a piece of musical data information memory. When a player shifts the mode of operation from the recording mode to the editing mode, a new sequence of pieces of musical data information are produced and memorized in addition to the pieces of musical data information which have already been memorized in the musical data information memory. The electronic musical instrument thus arranged is capable of overlapping the pieces of musical data informations for a new edition.

However, a problem is encountered in the prior-art electronic musical instrument in modification of a sequence of the pieces of musical data information representative of attributes of musical tones recorded in the musical data information memory. This sets limitations to editing mode of operation.

SUMMARY OF THE INVENTION

It is therefore an important object of the present invention to provide an electronic musical instrument which is capable of modification of a sequence of pieces of musical data information recorded.

To accomplish these objects, the present invention proposes to provide means for modifying a kind of musical data information specified by a player.

In accordance with the present invention, there is provided an electronic musical instrument operative to produce pieces of musical data information in a recording mode of operation while a player performs a music having a plurality of musical tones, said electronic musical instrument being further operative to reproduce the music tones on the basis of said pieces of musical data information in a playback mode of operation, said pieces of musical data information including at least one piece of timing data information representative of a lapse of time and pieces of note data information representative of a chord and associated with the timing data information, said pieces of note data information and said timing data information being produced upon detection of a plurality of keying-in operations concurrently carried out. In accordance with the present invention, an electronic musical instrument includes memory means operative to memorize said pieces of musical data information in said recording mode of operation and to read out the pieces of musical data information in said playback mode of operation; checking means operative to check said memory means to find said piece of timing data information in said playback mode of operation, said piece of timing data information being read out in a nearly simultaneous timing; modifying means operative to produce a broken-chord on the basis of said pieces of note data information read out from said memory means when said checking means find said piece of timing data information; and, controlling means operative to cause said checking means to check said memory means for allowing said modifying means to produce said broken-chord.

Further, there is provided an electronic musical instrument capable of producing musical tones on the basis of a sequence of pieces of musical data information, comprising (a) memory means for storing the pieces of musical data information grouped by time durations with respect to a beginning of a performance, (b) modification range defining means for specifying a head position and a terminational position in the pieces of musical data information, (c) setting means for establishing a variation, (d) modifying means for modifying each piece of first musical data information between the head position and the terminational position on the basis of the variation.

The first musical data information may be of a piece of timing data information representative of the lapse of time from the head position of each bar and the variation represents an amount of time, so that the modifying means add the variation to the first musical data information. However, in one implementation, the first musical data information contains a piece of key-touch data information representative of an initial key-touch proportional to a loudness of a musical tone and the variation represents an amount of an initial key-touch, so that the modifying means add the variation to the first musical data information. In another implementation, the first musical data information is provided with a plurality pieces of depressed-key data information produced upon substantially simultaneous key-depressions, and the modifying means separate each piece of depressed-key data information from others so as to produce a broken-chord.

The electronic musical instrument may further comprise message producing means operative to produce a prompt message in association with the setting means.

BRIEF DESCRIPTION OF THE DRAWINGS

The features and advantages of an electronic musical instrument with an editor according to the present invention will be more clearly understood from the following description taken in conjunction with the accompanying drawings in which.

DESCRIPTION OF THE PREFERRED EMBODIMENT

Structure of Electronic Musical Instrument

Figure 1:
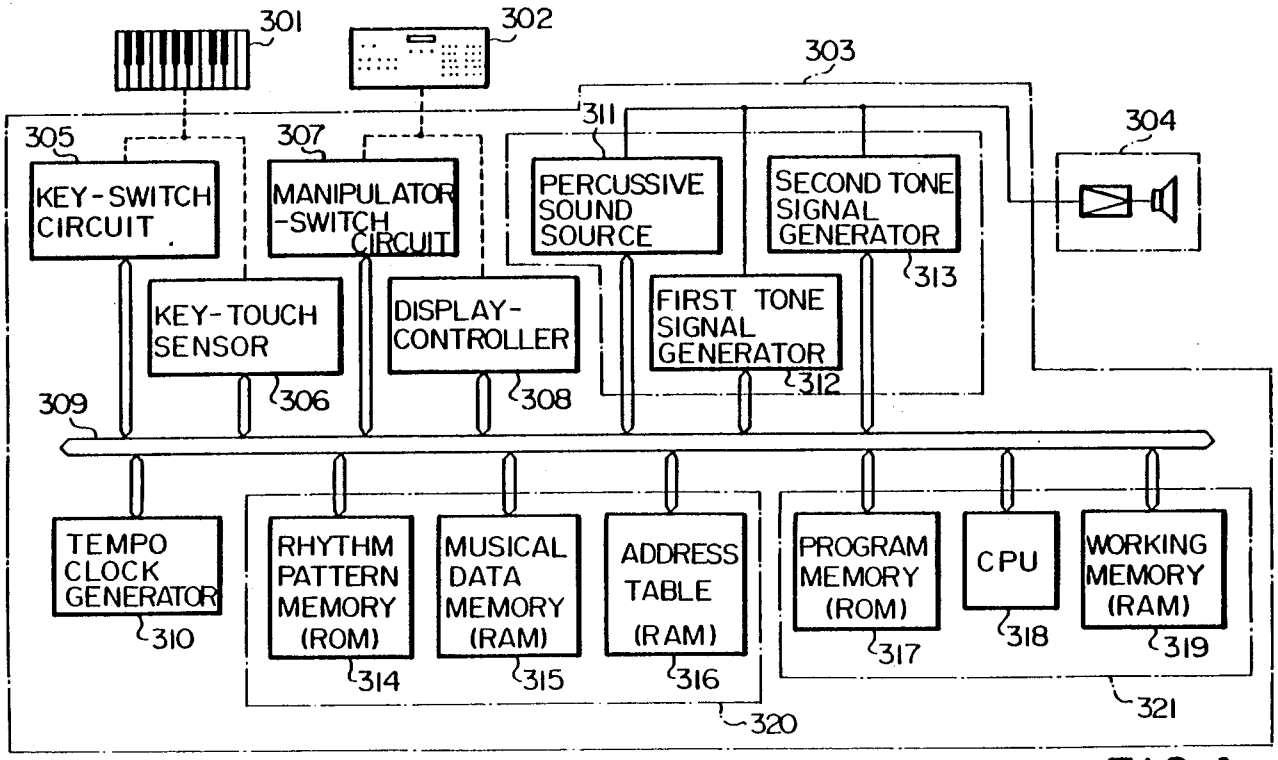
FIG. 1 is a block diagram showing the structure of an electronic keyboard system embodying the present invention.

Referring first to FIG. 1 of the drawings, there is illustrated the general arrangement of an electronic keyboard system embodying the present invention. The electronic keyboard system largely comprises a keyboard 301 provided with a plurality of white keys and a plurality of black keys, a control board 302, electronic modules 303 and a sound system 304 and is capable of being shifted into an usual playing mode of operation, a recording mode of operation, a playback mode of operation or an editing mode of operation.

The keyboard 301 is associated with a key-switch circuit 305 and with a key-touch sensor 306. The key-switch circuit 305 is provided with a plurality of key-switches equal in number to the keys and is operative to detect a key or keys depressed or released by a player for producing key-state signals each representative of a piece of key-state information including the key-code assigned to the key depressed or released. The key-touch sensor 306 operates in association with the key-switch circuit 305 and detects a touch of each key depressed by the player, i.e., the strength of the touch, the velocity of the key movement and so forth for producing a key-touch signal representative of a piece of key-touch data information including the strength of the touch and the velocity of the key movement.

Figure 2:
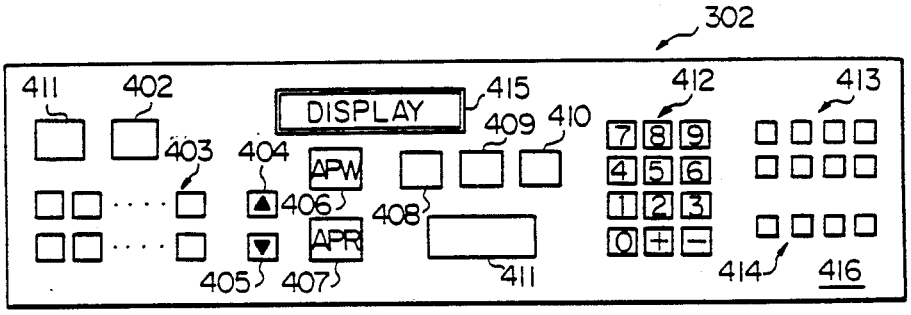
FIG. 2 is a front view showing the arrangement of the manipulating switches provided on the front panel of the control board forming part of the electronic keyboard system.

The control board 302 is provided with manipulating switches and a display window and which operate in association with a manipulator-switch detecting circuit 307 and a display-controller 308, respectively. In detail, FIG. 2 shows the arrangement of the manipulating switches 401 to 414 and the display window 415 provided on a front panel 416 of the control board 302. The manipulating switch 401 is used for production of percussive sounds, and, on the other hand, the manipulating switch 402 is depressed for termination of the percussive sounds. A set of manipulating switches 403 is provided for selecting a rhythm pattern from a group of candidates such as, for example, march, waltz and so on. A pair of manipulating switches 404 and 405 are used to vary the tempo of a music in opposite directions to each other. When the player wants to shift the electronic keyboard instrument into the recording mode of operation, the manipulating switch 406 is depressed, however the electronic keyboard instrument will be shifted into the playback mode of operation upon depression of the manipulating switch 407.

Figure 12A:
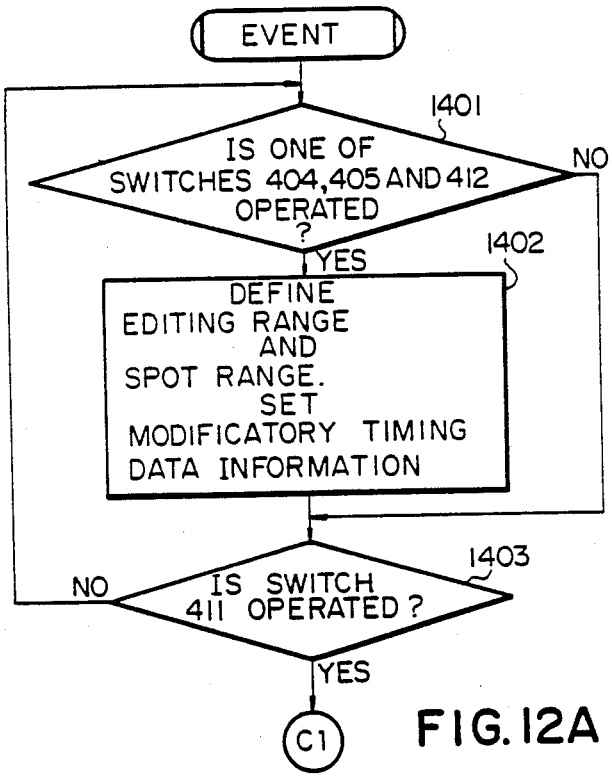
FIGS. 12A and 12B are flowcharts showing a timing-editing sub-routine program executed by the central processing unit in the editing mode of operation.
Figure 12B:
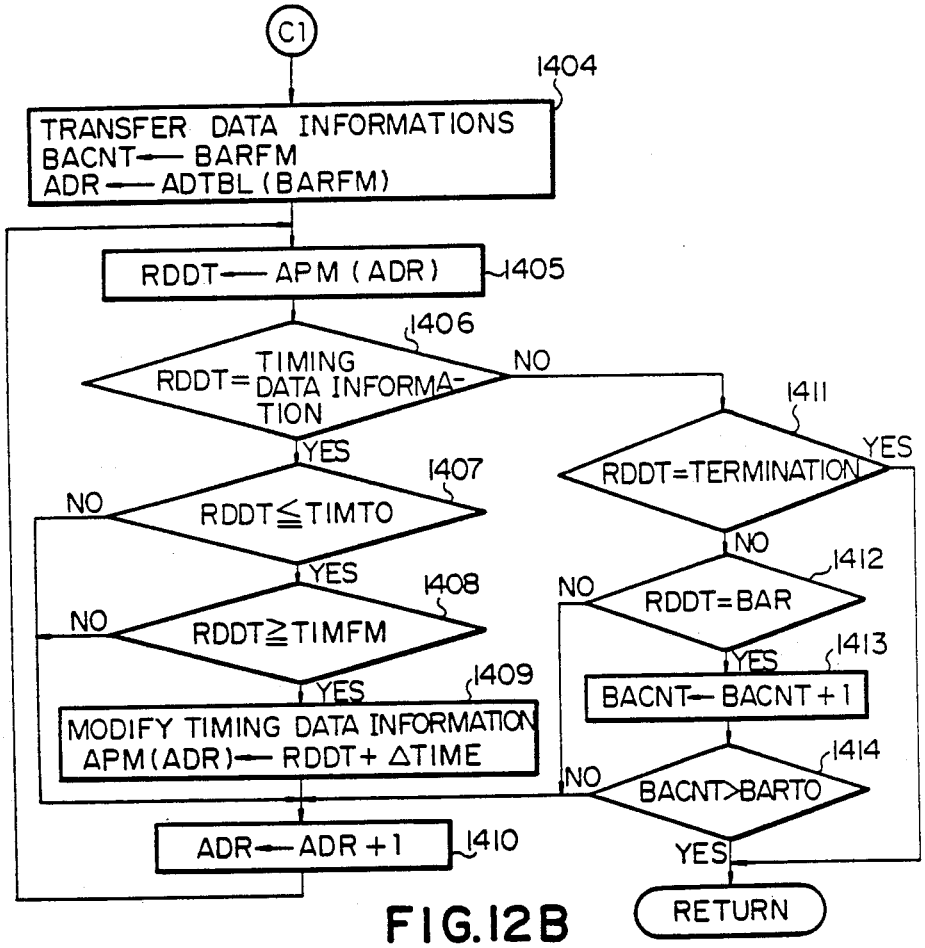

The manipulating switches 408, 409, 410 and 411 are provided in association with the editing mode of operation, and the editing mode of operation is carried out for changing pieces of musical data information representative of attributes of a part of the music which has been already memorized during the recording mode of operation. In detail, the manipulating switch 408 is depressed when the player wants to change the beat or a production timing of musical tone for a part of the music when the electronic keyboard system is shifted into the playback mode of operation. This operation is called as "timing-editing operation" and will be described in detail with reference to FIGS. 12A and 12B of the drawings. The manipulating switch 409 is provided for changing the touches of the musical tones of a part of the music reproduced during the playback mode of operation. If the musical tones are changed in touch, the loudness of each musical tone will be altered as if the touch of key depressed is changed from the original keying-in operation, then this editing operation is hereinunder called as "touch -editing operation" and will be described with reference to FIGS. 14A and 14B. When the player wants to break the chord originally produced in the recording mode of operation into individual musical tones reproduced in series in the playback mode of operation, the manipulating switch 410 will be depressed. This editing operation is convenient to produce a broken chord such as, for example, an arpeggio or an alberti-bass on the basis of the chord the pieces of musical data information of which have been already memorized in the recording mode of operation, then this operation will be called as "separate-editing operation". Thus, the manipulating switches 408 to 410 are selectively used to allow the control to enter into one of the three editing operations, however the manipulating switch 411 is commonly used in the three editing operations so as to fix the contents of a modification. The manipulating switch 411 is also used in the playback mode of operation for establishing a playback range. Detailed description of the separate-editing operation will be made with reference to FIGS. 15A, 15B, 17A and 17B.

A set of manipulating switches 412 consisting of ten-keys and a pair of sign keys (which are "+" key and "−" key) are used in association with the manipulating switches for giving variations or establishing an editing range or a spot range in connection with the editing operations or the playback mode of operation. A set of manipulating switches 413 are provided for selection of timbre imparted to musical tones produced in the usual playing mode of operation and reproduced in the playback mode of operation. If the player wants to impart any effect to the musical tones, a set of manipulating switches 414 will be selectively depressed.

As described hereinbefore, the control board 302 is associated with the manipulator-switch detecting circuit 307, so that an actuation of each manipulating switch is detected by the circuit 307. The manipulator-switch detecting circuit 307 produces a detecting signal representative of an operation or an actuation of the manipulating switch and supplies the detecting signal to a multi-bit bus system 309. The actuations of some manipulating-switches causes the display-controller 308 to activate, so that the display window indicates a word, words, abbreviation or a sign corresponding to the manipulating switch or switches actuated by the player for providing a prompt or acknowledgement.

The multi-bit bus system 309 is shared by component circuits of the electronic modules 303 which include a tempo clock generator 310, a percussive sound source 311, a first tone signal generating circuit 312 dedicated to the usual playing mode of operation or keying-in operations on the keyboard 301, a second tone signal generating circuit 313 dedicated to the playback mode of operation, a rhythm pattern memory 314, a musical data memory 315, an address table 316, a program memory 317, a central processing unit (which is abbreviated as CPU in FIG. 1) 318, and a working memory 319. Each of the rhythm pattern memory 314 and the program memory 317 are of a read-only memory, but the musical data memory 315, the address table 316 and the working memory 319 are of a random access memory. The rhythm pattern memory 314, the musical data memory 315 and the address table forming in combination a data storage unit 320, and the central processing unit 318, the program memory 317 and the working memory 319 as a whole constitute a microcomputer unit 321. The tempo clock generating circuit 310 is operative to intermittently produce a tempo clock signal or an interrupt signal, and the tempo clock signal is supplied to the central processing unit 318 through the multi-bit bus system 309 so as to cause the control thereof to be branched from a main routine program to a subroutine program related to the production of the percussive sound. The percussive sound source 311 is provided with a plurality of percussive sound generating circuits each responsive to a rhythm pattern data signal fed from the central processing unit 318, and the rhythm pattern data signal is representative a piece of rhythm pattern data information. The pieces of rhythm pattern data information are grouped in the rhythm pattern memory 314 by rhythm patterns, and the pieces of rhythm pattern data information of each rhythm patter are used to produce a series of percussive sounds for a single bar. A percussive sound signal is produced by each of the percussive sound generating circuits on the basis of the rhythm pattern data information and is, then, mixed with a tone signal (which is described hereinunder in connection with the first and second tone signal generating circuits) and supplied to the sound system 304. The percussive sound signal causes the sound system 304 to produce one of the percussive sounds such as, for example, a cymbal sound or a bass drum sound.

Each of the first and second tone signal generating circuits 312 and 313 is provided with a plurality of tone signal generating channels for producing tone signals on the basis of the pieces of musical data information fed from the central processing unit 318, respectively, and the tone signals are mixed with the percussive sound signal, if any, and provided to the sound system 304.

The central processing unit 318 transfers the key-state and pieces of key-touch information produced by the keying-in operations on the keyboard 301 and a piece of tone color and effect information produced upon actuations of the manipulating switches 413 and 414 from the working memory to the first tone signal generating circuits 312 during the usual playing mode of operation, however the second tone signal generating circuit 313 is activated during the playback mode of operation with the pieces of musical data information fed from the musical data memory 315. The pieces of musical data information are coded in various information formats, respectively, which will be described hereinunder.

Information Formats

In this instance, the words "musical data information" are used for a piece of data information memorized in the musical data memory 315, and the pieces of musical data information include a piece of timing data information, a piece of depressed-key data information, a piece of released-key data information, a piece of tone color and effect data information, a piece of bar data information and a piece terminational data information. Each of the pieces of musical data information will be hereinunder described in detail.

Figure 3:
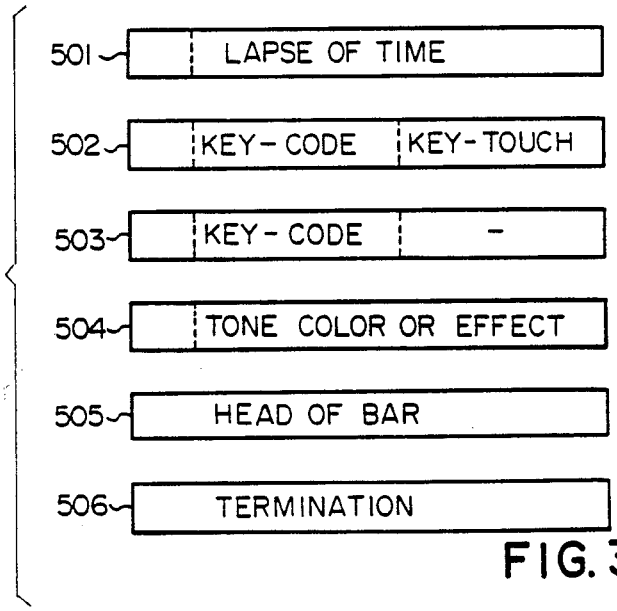
FIG. 3 is a view showing the information formats of the pieces of musical data information stored in the musical data memory incorporated in the electronic keyboard system.

Turning to FIG. 3 of the drawings, there is shown various kinds of data information formats 501 to 506 applied to the pieces of musical data information, respectively, and each piece of musical data information consists of a predetermined number of data bits.

Timing data information

The timing data information is coded into the information format 501, and the information format has a relatively smallnumber of high-order bits for indication of the timing data information and a relatively large-number of low-order bits representing a lapse of time measuring from the head position of a bar concerned. The lapse of time is represented by the number of the tempo clock signals counted from the head position of the bar to production thereof.

Depressed-key data information

The depressed-key data information is coded into the information format 502, and the information format 502 has a relatively small number of high-order bits for indication of the depressed-key data information, an intermediate number of middle-order bits representative of the key code information assigned to the key depressed by the player and an intermediate number of low-order bits representative of the key-touch data information.

Released key-data information

The released-key data information is coded into the information format 503, and the information format 503 has a relatively small number of high-order bits for indication of the released-key data information, and an intermediate number of middle-order bits representative of the key code information assigned to the key released by the player, but the low-order bits should be ignored.

Tone color and effect data information

The tone color and effect data information is coded into the information format 504, and the information format 504 has a relatively small number of high-order bits representative of the tone color data information or the effect data information, and a relatively large number of low-order bits representative of a tone color or an effect specified by actuation of the manipulating switches 413 or 414.

Bar head position data information

The bar head position data information is coded into the information format 505, and all bits of the information format 505 are used for establishing a boundary between two groups of pieces of data information respectively produced during respective keying-in operations for adjacent two bars.

Terminational position data information

The terminational position data information is coded into the information format 506, and all bits of the information format 506 are used to indicate the termination of a sequence of the pieces of musical data information produced during keying-in operations for a music.

The musical data memory 315 memorizes various kinds of the pieces of musical data information thus described hereinbefore, so that it may be convenient for the playback mode of operation or the editing mode of operation that the pieces of bar head position data information are sequentially pointed by something like a pointer. In this instance, the address table 316 is provided for pointing out the addresses where the pieces of bar head position data information are stored, respectively. Each memory location in the address table 316 is abbreviated by ADTBL(n), and "n" represents the position of the bar in a score.

When a power switch (not shown) turns on, the central processing unit 318 repeats a main routine program until any key is depressed or released, (which is hereinunder referred to as "key-on event" or as "key-off event), or a manipulating switch is actuated by the player (which is hereinunder referred to as "manipulating-switch actuation event". The key-on event or the key-off event interrupts the execution of the main routine program and, then, the control is branched to various sub-routine programs. In the executions of these programs, the working memory 319 is used to temporary store various informations such as a piece of flag information or a piece of data information produced during the execution of one of the sub-routine programs. Since the pieces of flag information and the pieces of data information are frequently referred to in the following description, these are briefly described hereinunder for better understanding.

Rhythm run flag information (RUN)

The rhythm run flag information (RUN) represents the state of the percussive sound source 311, i.e., an activated state or an idle state. If the percussive sound source 311 is in the activated state to produce the rhythm pattern data signal, the rhythm run flag information has binary value "1". However, if the rhythm run state flag information has binary value "0", the percussive sound source 311 is in the idle state.

Auto-play write flag information (APW)

The auto-play write flag information (APW) is set to binary value "1" to indicate the recording mode of operation where the pieces of musical data informations are sequentially memorized into the musical data memory 315 in accordance with the keying-in operations on the keyboard 301, but if the auto-play write flag information has binary value "0", the electronic keyboard system is shifted into another operation mode.

Auto-play read flag information (APR)

When the auto-play read flag information (APR) has binary value "1", the pieces of musical data information are read out from the musical data memory 315 for the playback mode of operation. The auto-play read flag information of "0" indicates that the central processing unit 318 is out of the playback mode of operation.

Tempo count data information (TCNT)

The tempo count data information (TCNT) is incremented by application of the tempo clock signal fed from the tempo clock generator 310 and cleared upon termination of a bar. Then the tempo count data information represents a progressive position or a lapse of time measuring from the head position of a bar.

Bar count data information (BACNT)

The bar count data information (BACNT) is representative of the number of the bars for which the electronic keyboard system have already reproduced the musical tones and/or the percussive sounds Address data information (ADR)

The address data information (ADR) represents the memory location in the musical data memory 315.

Read-out data information (RDDT)

The words "read-out data information (RDDT)" are used for the data information read out from the musical data memory 315.

Read-out timing data information (RDTDT)

The read-out timing data information (RDTDT) indicates that musical data information read out from the musical data memory 315 is of the timing data information.

Starting bar data information (BARFM)

The starting bar data information (BARFM) indicates the location of the bar where the playback mode of operation or the editing mode operation should start.

Terminational bar data information (BARTO)

The terminational bar data information (BARTO) indicates the location of the bar where the playback mode of operation or the editing mode of operation should be completed.

Starting timing data information (TIMFM)

The starting timing data information (TIMFM) indicates the starting position or timing in the bar specified by the starting bar data information, so that the reproduction or the modification is carried out from the timing specified by this data information in the playback mode of operation or the editing mode of operation.

Terminational timing data information (TIMTO)

The terminational timing data information (TIMTO) indicates the terminational position or timing in the bar specified by the terminational bar data information, so that the reproduction or the modification is finished at the timing specified by this data information in the playback mode of operation or the editing mode of operation.

Modificatory timing data information (dTIME)

The modificatory timing data information (dTIME) indicates the amount of time duration used for modification of the lapse of time in the timing editing operation.

Modificatory touch data information (dKTD)

The modificatory touch data information (dKTD) indicates the amount of key-touch used for modification of the key-touch data information in the touch editing operation.

Broken-chord pattern data information (STYP)

The broken-chord pattern data information (STYP) is used in the separate-editing operation so as to provide a broken chord pattern. If the broken-chord pattern data information has binary value "1", the chord is broken into a series of musical tones arranged from the component musical tone with the highest pitch to the component musical tone with the lowest pitch. On the other hand, if the broken-chord pattern data information has binary value "0", the chord is broken into the component musical tones arranged in the opposite direction.

Key buffer data information (KEYBUF(N))

If a piece of read-out data information is of the depressed-key data information in the separate-editing mode of operation, the depressed-key data information is temporally stored in the working memory 319 as the rearranging data information (KEYBUF(n)).

Rhythm pattern specifying data information

The rhythm pattern specifying data information is used for specifying the pieces of rhythm pattern data information corresponding to the rhythm pattern selected upon actuation of one of the manipulating switches 403.

First timing buffer data information (TIMBUF1)

The first timing buffer data information (TIMBUF1) is established in the separate-editing operation and indicates the timing data information related to the depressed-key data information checked to see if it is produced upon simultaneous keying-in operations.

Second timing buffer data information (TIMBUF2)

When the read-out data information is of the timing data information in the separate-editing operation, the second timing buffer data information is also established for temporal shunting of the first timing data information, so that the second timing buffer data information is identical with the previous first timing buffer data information.

Count data information (N)

The count data information (N) represents the number of the pieces of key buffer data information.

Index data information (I)

The index data information (I) is used to control the repetition for rearranging the pieces of depressed-key data information produced upon simultaneous keying-in operations.

Main Routine (1)

Figure 4:
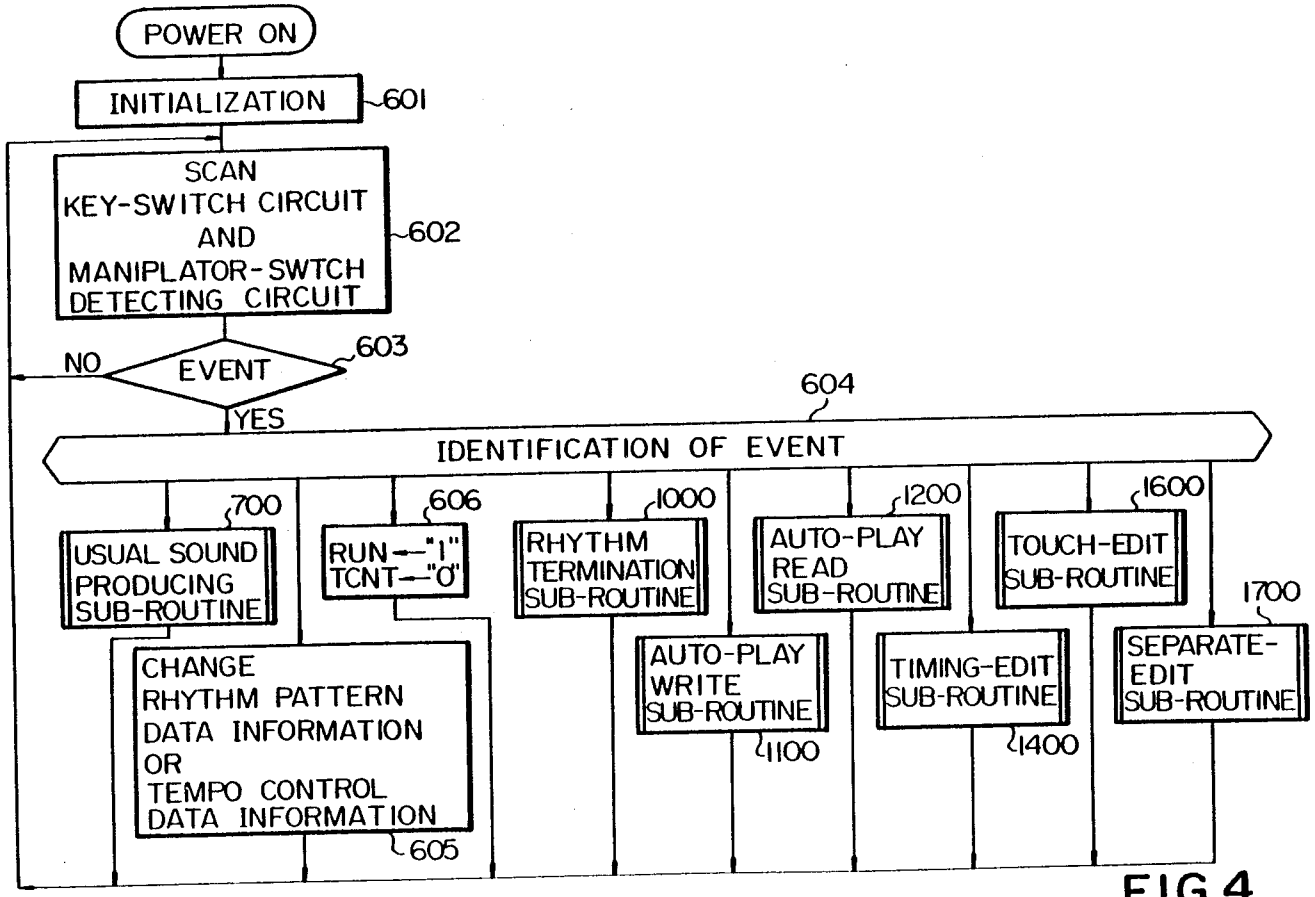
FIG. 4 is a flowchart showing a main routine program executed by the central processing unit incorporated in the electronic keyboard system.

Description is hereinunder made for the main routine program executed by the central processing unit 318 with reference to FIG. 4 of the drawings. When a power supply switch (not shown) is depressed and turns on for activation of the electronic keyboard system, the microcomputer unit 321 starts operations. The central processing unit 318 first executes an initializing program as by step 601 to set all of the pieces of data information and the pieces of flag information to respective starting values and to clear the registers of the working memory 319, respectively. When the initializing program is completed, the central processing unit 318 proceeds to step 602 to checks into the key-switch circuit 305 to see if any one of the keys are depressed or released and into the manipulator-switch detecting circuit 307 to see whether or not any one of the manipulating switches 401 to 414 is operated. If there is no key depressed or released by the player, the central processing unit 318 returns to step 602 to check into the key-switch circuit 305. Similarly, if it is found no manipulating switch is operated by the player, the central processing unit 318 returns to step 602 to check into the manipulator-switch circuit 307. Thus, the central processing unit reiterates the loop consisting of steps 602 and 603.

If there is detected the key-on event, the key-off event or the manipulating-switch actuation event by the central processing unit 318, the central processing unit 318 proceeds to step 604 to specify or identify the key or the manipulating switch detected in step 603. When the central processing unit 318 identifies the event detected in step 603, the control is branched to one of sub-routine programs depending upon the event identified. Namely, if a key is depressed or released by the player, the control is branched to an usual sound producing sub-routine program 700 illustrated in FIG. 5. If the manipulating switches 413 and 414 are operated by the player, the central processing unit 318 also executes the usual sound producing sub-routine program 700. The main routine program is repeated in all modes of operation, however the control of the central processing unit 318 is branched to different sub-routine programs depending upon the mode of operation. Then, description is firstly focused upon the usual playing mode of operation, then upon the recording mode of operation, then upon the playback mode of operation, and finally upon the editing mode of operation.

Usual playing mode of operation

Usual sound producing sub-routine

When the central processing unit 318 identifies one of the keys, the manipulating switches 413 and/or the manipulating switches 414 in step 604, the central processing unit 318 starts the execution of the usual sound producing sub-routine program 700 as by step 701. The central processing unit 318 have already fetched all of the pieces of data information produced upon the key-on event, the key-off event and/or the manipulating switch actuation event, so that the central processing unit 318 transfers the pieces of data information to event-buffer registers defined in the working memory 319 for temporal storage as by step 702. The pieces of data information temporary stored in the event-buffer registers include the key-code data information, the key-touch data information, the tone color data information and the effect data information, and these pieces of data information are hereinunder referred to as "event pieces of data information".

In detail, if the player wants to change the tone color, one of the manipulating switches 413 is actuated to specify a new tone color. The actuation of the manipulating switch is detected by the manipulator-switch detecting circuit 307 to produce the detecting signal which is fetched by the central processing unit 318. The central processing unit 318 decides the new tone color on the basis of the detecting signal, then the new tone color data information is coded into the information format 504 and transferred to the event-buffer registers. During the usual playing mode of operation, one of the manipulating switches 414 is actuated, the manipulator-switch detecting circuit 307 also produces the detecting signal which is fetched by the central processing unit 318. The central processing unit decides a new effect applied to the musical tone or tones, and the effect data information representative of the new effect is coded into the information format 504 and transferred to the event-buffer registers for temporary storage. However, there is no manipulating switches forming part of the switches 413 and 414, a standard tone color and no effect are applied to a musical tone.

In this situation, if a key is depressed by the player, the key-on event is detected by the key-switch circuit 305 to produce the key-state signal and the key-touch is also detected by the key-touch sensor 306 to produce the key-touch signal. These signals are fetched by the central processing unit 318, and the central processing unit 318 produces the depressed-key data information on the basis of the key-state signal and the key-touch signal, so that the depressed-key data information is coded into the information format 502 to store in the event-buffer registers. Thus, the event-buffer registers of the working memory 319 temporary storage the pieces of data information necessary for production of the tone signal. When all of the pieces of data information are memorized in the event-buffer registers of the working memory 319, the central processing unit 318 reads out the pieces of data information from the event-buffer registers and, then, provides the pieces of data informations to the first tone signal generating circuit 312 as by step 703. With the pieces of data informations stored in the event-buffer registers, the first tone signal generating circuit 312 produces the tone signal representing the key-code assigned to the key depressed by the player, the strength of the touch and so on. For production of the tone signal, the key-touch data information is used for decision of the loudness of the musical tone, and the tone data information is used to form an envelope of the tone signal. The tone signal is supplied from the first tone signal generating circuit 312 to the sound system 304, so that the musical tone is electrically produced on the basis of the tone signal.

On the other hand, when the central processing unit 318 detects the key-off event, the released-key data information is produced for the key released by the player, and, then, the released-key data information is transferred to the event-buffer registers in the working memory 319 for temporary storage. The released-key data information is then read out from the event-buffer registers for transferring to the first tone signal generating circuit 312. With the released-key data information, the first tone signal generating circuit 312 terminates the production of the tone signal, so that no musical tone is electrically produced by the sound system 304.

When the programed instructions related to step 703 are executed by the central processing unit 318, the central processing unit 318 checks into the working memory 319 to see if the auto-play write flag information (APW) has the binary value "1" as by step 704. In the usual playing mode of operation, the manipulating switch 406 has not been depressed by the player, so that the answer for the decision step 704 is given in the negative. Then, the central processing unit 318 proceeds to step 705 to clear the event-buffer registers in the working memory 319. When all of the event-buffer registers are cleared, the central processing unit 318 returns to step 602 in the main routine program shown in FIG. 4.

Main routine (2)

Assuming now that the manipulating-switch actuation event is occurred during the reiteration of the loop consisting of steps 602 and 603, the answer in the decision step 603 is given in the positive, so that the central processing unit 318 proceeds to step 604 to identify the manipulating switch actuated by the player. If the central processing unit 318 finds that the manipulating-switch actuating event is occurred in connection with one of the manipulating switches 403, 404 and 405, the central processing unit 318 proceeds to step 605 to change the rhythm pattern specifying data information. As described above, one of the manipulating switches 403 is operated for selecting a rhythm pattern, and the manipulating switches are used for varying the tempo. Namely, if the central processing unit 318 finds that one of the manipulating switches 403 is actuated for changing the rhythm from, for example, waltz to, for example, march. The central processing unit 318 provides the new rhythm pattern specifying data information indicative of the rhythm pattern data information of the march to the working memory 319, then the new rhythm pattern specifying data information is stored in the working memory.

On the other hand, if the central processing unit 318 finds that either manipulating switch 404 or 405 is depressed, the central processing unit 318 produces a piece of new tempo control data information indicative of an increased or decreased tempo which is transferred to the tempo clock generator 310. The incremental quantity or the decremental quantity depends upon the time duration during which the manipulating switch 404 or 405 is depressed. With the new tempo control data information, the tempo clock generator 310 modifies the tempo clock signal in frequency. When all of the instructions concerning step 605 are executed, the central processing unit 318 returns to step 602 and reiterates the loop consisting of steps 602 and 603.

Rhythm production sub-routine

Figure 6:
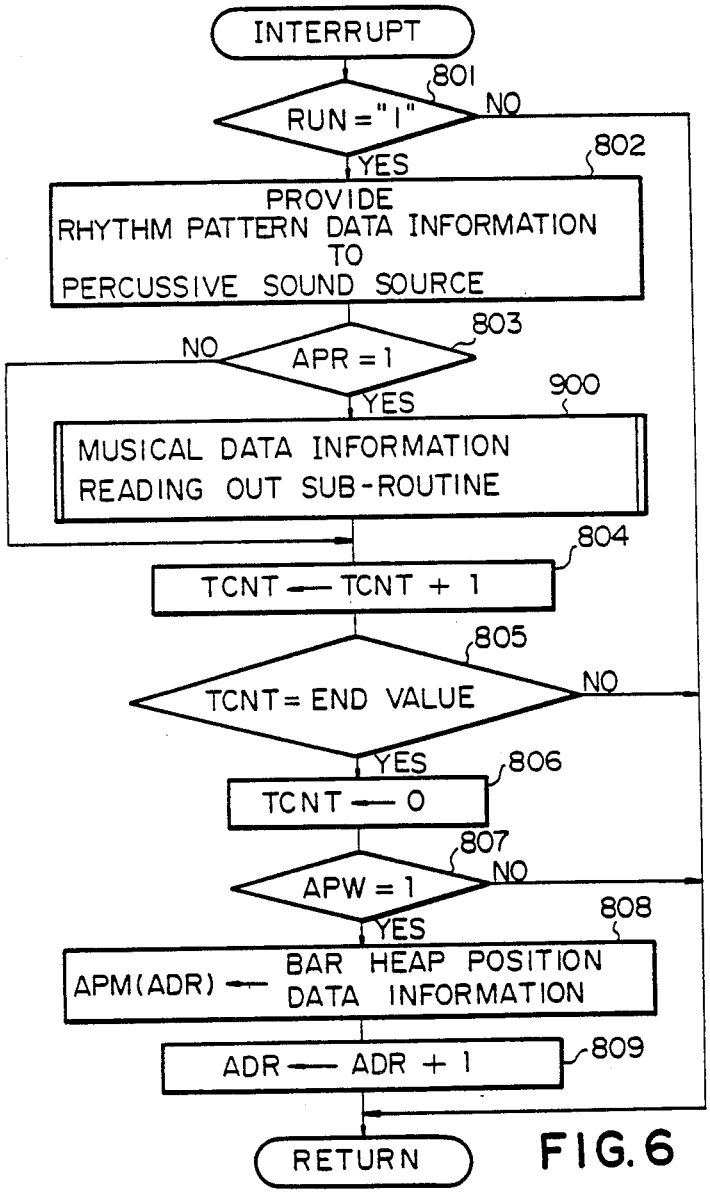
FIG. 6 is a flowchart showing a rhythm production sub-routine program executed by the central processing unit in a playback mode of operation, the usual playing mode of operation or the recording mode of operation.

If the central processing unit 318 detects the manipulating-switch actuating event at step 603 and, thereafter, finds that the manipulating switch 401 is operated for production of a percussive sound as by step 604, the central processing unit 318 proceeds to step 606 to set the rhythm run flag information (RUN) stored in the working memory 319 to binary value "1". The central processing unit 318 further sets the tempo count data information (TCNT) to the initial value of "0". When all of the instructions concerning step 606 are executed, the central processing unit 318 returns to step 602 and reiterates the loop consisting of step 602 and 603. During the reiteration of the loop consisting of step 602 and 603, if the tempo clock signal is applied to the central processing unit 318, the main routine program is interrupted and the control is branched to the rhythm production sub-routine program illustrated in FIG. 6. The central processing unit 318 first checks into the working memory 319 to see whether or not the rhythm run flag information (RUN) is set to binary number "1" as by step 801. As described above, the central processing unit 318 set the rhythm run flag information (RUN) to binary number "1" at step 606 upon actuation of the manipulating switch 401, so that the answer in the decision step 801 is given in the positive. However, if it is found that the answer in the decision step 801 is in the negative, the central processing unit 318 returns to the main routine program without execution of steps 802 to 809. In this instance, every tempo clock signal interrupts the main routine program, however the central processing unit 318 immediately returns to the main routine program without transferring the rhythm pattern data information specified by the rhythm pattern specifying data information, so that no percussive sound is produced by the sound system 304 in so far as the manipulating switch 401 is not operated by the player.

Figure 7:
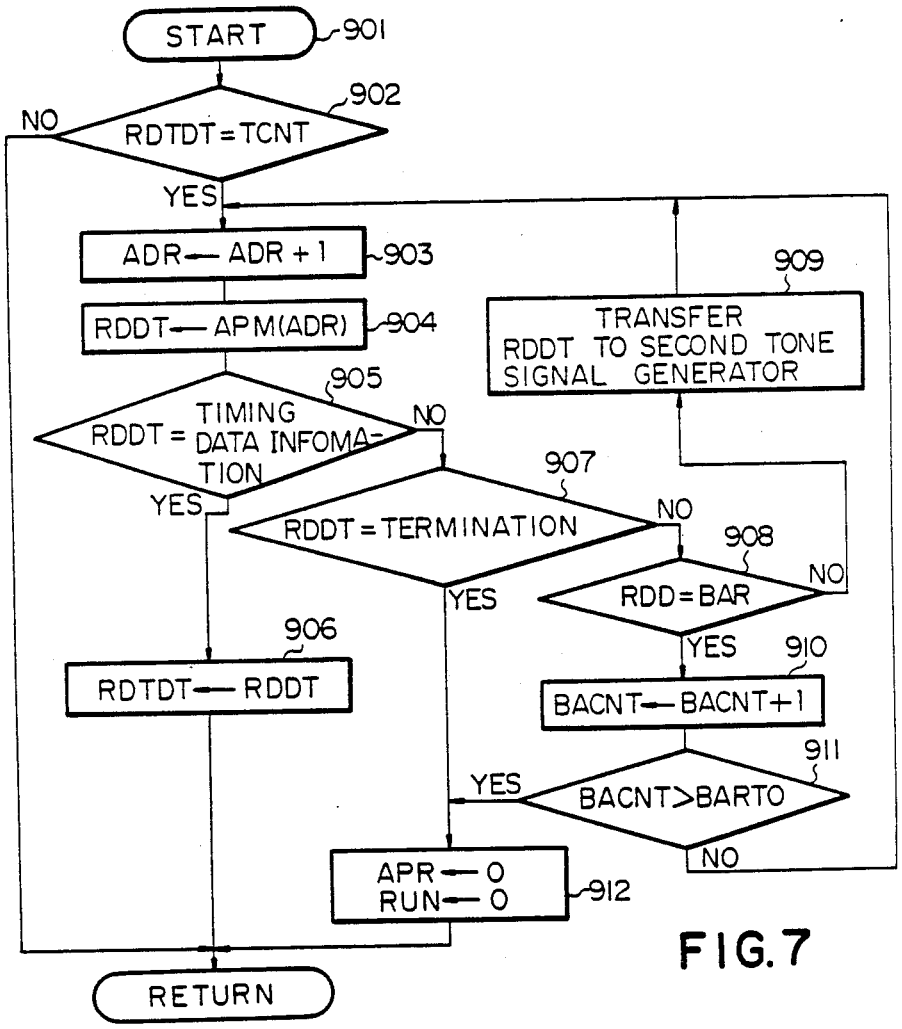
FIG. 7 is a piece of flowchart showing a musical data information reading out sub-routine program executed by the central processing unit in the playback mode of operation.

In step 802, the central processing unit 318 fetches each of the pieces of rhythm pattern data informations specified by the rhythm pattern specifying data information stored in the working memory 319 in synchronous with the tempo clock signal, and, then the rhythm pattern data information read out from the rhythm pattern memory 314 is transferred to the percussive sound source 311. With the rhythm pattern data information, the percussive sound source 311 begins to produce the percussive sound signal, and the percussive sound signal is provided to the sound system 304 for production of the percussive sound. When the rhythm pattern data information is transferred to the percussive sound source 311, the central processing unit 318 proceeds to step 803 to check into the working memory 319 to see if the auto-play read flag information (APR) has been set to binary number "1". If the electronic keyboard system is shifted into the playback mode of operation, the answer in the decision step 803 is given in the positive, so that the control is branched to a piece of musical data information reading out sub-routine program (which is hereinunder described with reference to FIG. 7) as by step 900. However, the manipulating switch 407 was not actuated in the usual playing mode of operation, so that the answer in the decision step 803 is given in the negative. Then, the central processing unit 318 proceeds to step 804 without execution of the musical data information reading out sub-routine program. In step 804, the tempo count data information (TCNT) is incremented by "1". The central processing unit 318 proceeds to step 805 to check into the working memory 319 to see whether or not the tempo count data information (TCNT) reaches the value indicative of the end of the bar. The pieces of rhythm pattern data information are stored in the rhythm pattern memory 314 to produce a series of percussive sounds for a single bar, so that the answer in the decision step 805 is given in the negative before the percussive sound reaches the end of the bar. Then, the central processing unit 318 returns to the main routine program which will be interrupted by the subsequent tempo clock signal. Thus, each of the tempo clock signals interrupts the main routine program to cause the central processing unit 318 to execute the rhythm production sub-routine program until the answer in the decision step 805 is given in the positive. If it is found that the answer in the decision step 805 is in the positive, the central processing unit 318 proceeds to step 806 to set the tempo count data information (TCNT) to the initial value of "0". Thereafter, the central processing unit 318 checks into the working memory 319 to see if the auto-play write flag information (APW) has been set to binary value "1". In the usual playing mode of operation, the manipulating switch 406 has never been actuated, so that the answer in the decision step 807 is given in the negative. Then, the central processing unit 318 returns to the main routine program without execution of steps 808 and 809. However, if the electronic keyboard system is shifted to the recording mode of operator, the answer in the decision step 807 is given in the positive, however the recording mode of operation will be hereinunder described.

Thus, the central processing unit 318 repeats the execution of the rhythm production sub-routine program until the manipulating switch 402 is depressed for termination of the percussive sound.

Rhythm termination sub-routine

Figure 8:
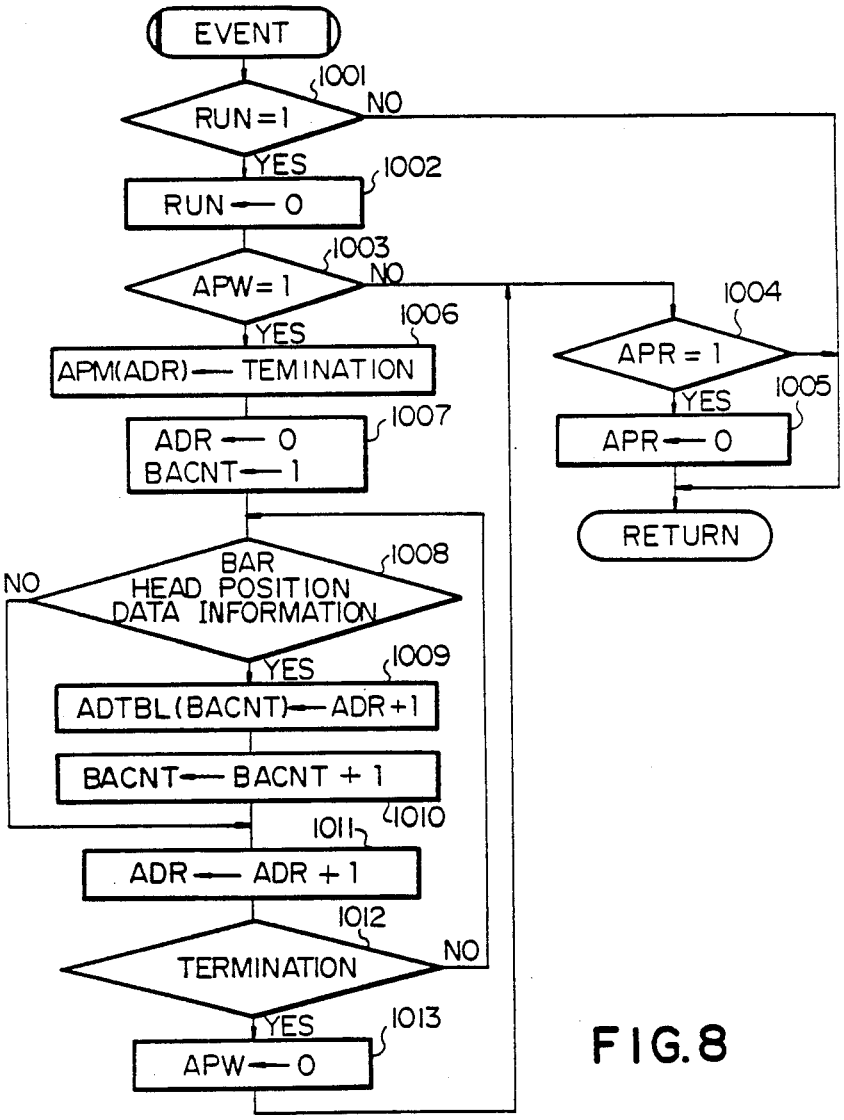
FIG. 8 is a flowchart showing a rhythm termination sub-routine program executed by the central processing unit in the usual playing mode of operation, the recording mode of operation or the playback mode of operation.

During the usual playing mode of operation, if the player wants to terminate the production of the percussive sound, the manipulating switch 402 is depressed. Then, the central processing unit detects the manipulating-switch actuating event as by step 603 of the main routine program and, then, finds that the manipulating-switch actuating event is occurred by actuation of the manipulating switch 402 as by step 604. The control is branched to a rhythm termination sub-routine program 1000 shown in FIG. 8. The rhythm termination sub-routine program 1000 starts with step 1001, then the central processing unit 318 checks into the working memory 319 to see if the rhythm run flag information (RUN) has been set to binary number "1". If it is found that the answer in the decision step 1001 is given in the positive, the central processing unit 318 changes the rhythm run flag information (RUN) from binary number "1" to binary number "0" as by step 1002. After the rhythm run flag information (RUN) is thus set to binary number "0" as by step 1002, the central processing unit 318 can immediately return from step 801 to the main routine program even if the tempo clock signal interrupts the main routine program without transferring the rhythm pattern data information to the percussive sound source 311. This results in termination of the percussive sound.

When the central processing unit 318 sets the rhythm run flag information (RUN) to binary value "0" in step 1002, the central processing unit 318 proceeds to step 1003 to check into the working memory 319 to see if the auto-play write flag information (APW) has been set to binary number "1", however the auto-play write flag information has binary value "0" in the usual playing mode of operation, so that the central processing unit 318 proceeds to step 1004 without execution of steps 1006 to 1013. In step 1004, the auto-play read flag information (APR) is read out from the working memory 319 to see if it has binary value "1". In the usual playing mode of operation, the auto-play read flag information is also set to binary number "0", so that the answer in the decision step 1004 is given in the negative. Then, the central processing unit 318 returns to step 602 of the main routine program. On the other hand, if the manipulating switch 402 is depressed after termination of the percussive sound, the control is also branched to the rhythm termination sub-routine program 1000. However, the answer in the decision step 1001 is given in the negative, so that the control immediately returns to step 602 of the main routine program without execution of step 1002.

Recording mode of operation

The recording mode of operation starts with actuation of the manipulating switch 406 and terminates upon actuation of the manipulating switch 402. If the central processing unit 318 identifies the manipulating switch 406 actuated by the player after detection of the manipulating-switch actuating event, the control is branched to an auto-play write sub-routine program 1100.

Auto-play write sub-routine

Figure 9:
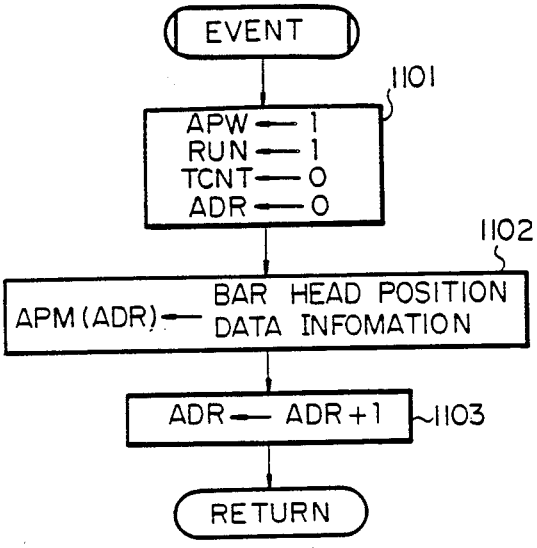
FIG. 9 is a flowchart showing an auto-play write sub-routine program executed by the central processing unit in the recording mode of operation.

The auto-play write sub-routine program shown in FIG. 9 starts with step 1101 in which the central processing unit 318 sets the auto-play write flag information (APW) and the rhythm run flag information (RUN) to binary number "1" but the tempo count data information (TCNT) and the address data information (ADR) are set to binary number "0". Then, the central processing unit 318 proceeds to step 1102 to write the bar head position data information into the memory location of the musical data memory 315 specified by the address data information (ADR) which is abbreviated by APM(ADR). When the bar head position data information is written into the memory location APM-(ADR), the address data information (ADR) is incremented by one as by step 1103. After incrementation of the address data information (ADR), the central processing unit 318 returns to step 602 of the main routine program and reiterates the loop consisting of steps 602 and 603.

Since the rhythm run flag information (RUN) was set to binary value "1" at step 1101, the central processing unit 318 can proceed to step 802 of the rhythm production sub-routine program upon interruption caused by the tempo clock signal. Then, the central processing unit 318 executes the instructions concerning step 802, so that the percussive sound source 311 begins to produce the percussive sound signal on the basis of the rhythm pattern data information supplied from the rhythm pattern memory 314, thereby causing the sound system 304 to produce the percussive sounds. The central processing unit 318 reiterates the loop consisting of steps 801 to 805 upon each interruption caused by the tempo clock signal for transferring the pieces of rhythm pattern data information. When the tempo count data information (TCNT) reaches the value representative of the end of the bar, the central processing unit 318 sets the tempo count data information (TCNT) to the initial value of zero. Thus, a series of the pieces of rhythm pattern data information is supplied to the percussive sound source 311, and, then, the central processing unit 318 checks into the working memory 319 to see if the auto-play write flag information (APW) is equal to binary value "1" as by step 807. In the recording mode of operation, the answer in the decision step 807 is given in the positive, so that the central processing unit 318 supplies the memory location APM(ADR) with the bar head position data information as by step 808 for storage. The address information (ADR) was incremented by one at step 1103, so that the pieces of bar head position data information are written into the memory locations of the musical data memory 315 as the pieces of rhythm pattern data information are retrieved for a single bar. Then, the central processing unit 318 proceeds to step 809 in which the address information (ADR) is incremented by one. Thus, the central processing unit 318 repeats the execution of the rhythm production sub-routine program, and the percussive sounds are produced by the sound system 304 as similar to the usual playing mode of operation.

Figure 5:
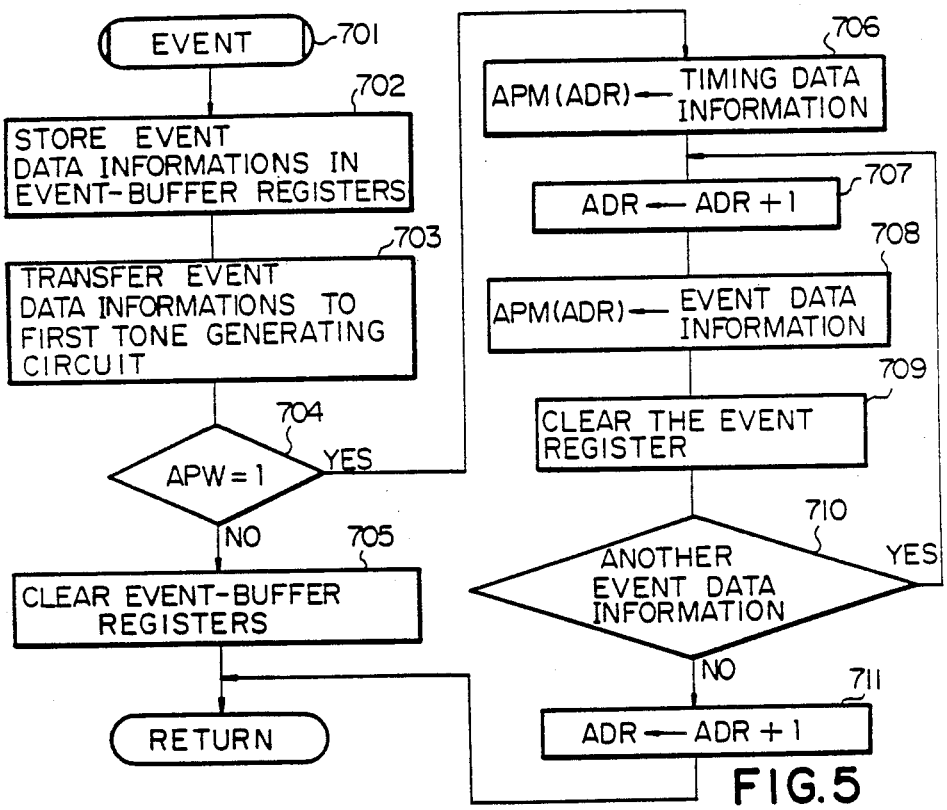
FIG. 5 is a flowchart showing an usual sound producing sub-routine program and a musical data recording sub-routine program executed by the central processing unit in an usual playing mode of operation and a recording mode of operation, respectively.

In this circumferences, if the player starts the keying-in operations on the keyboard 301 and actuates the manipulating switches 413 and 414, the control is branched to the usual sound producing sub-routine program shown in FIG. 5 in the similar manner to the usual playing mode of operation, so that the pieces of data information are temporary stored in the event buffer registers in the working memory 319 in step 702 and, then, the pieces of data information are transferred to the first tone signal generating circuits 312 in step 703 for production of the musical tones. However, when the central processing unit 318 checks into the working memory 319 to see if the auto-play write flag information (APW) is equal to binary value "1" as by step 704, the answer in the decision step 704 is given in the positive, then the central processing unit 318 executes a musical data recording sub-routine program shown in FIG. 5.

Musical data information recording sub-routine program

The musical data information recording sub-routine program starts with step 706 in which the central processing unit provides the musical data memory 315 with the timing data information for storing it in the memory location APM (ADR). The address data information (ADR) was incremented in step 809 of the rhythm production sub-routine program, so that the timing data information is memorized in the memory location next to the bar head position data information. After memorization of the timing data information, the central processing unit 318 proceeds to step 707 to add binary value "1" to the address data information (ADR), then further proceeding to step 708. In step 708, the central processing unit 318 fetches the event data information i.e., the depressed-key data information, the released-key data information or the tone color and effect data information, in the event-buffer registers depending upon the manipulating switch actuated by the player and, then, transfers to the musical data memory 315 for storing in the memory location APM (ADR) as a piece of musical data information. The address data information (ADR) was incremented in step 707, so that the event data information is memorized in the memory location next to the timing data information. When all of the instructions related to step 708 are executed, the event register storing the event data information fetched in step 708 is cleared by the central processing unit 318 as by step 709, then proceeding to step 710 to check into the event registers to see whether or not another event data information is stored. If there is another event data information in the event registers, the central processing unit 318 returns to step 707 to fetch and transfer the event data information to the musical data memory 315 as another piece of musical data information. Thus, the central processing unit 318 reiterates the loop consisting of steps 707 to 710 until all of the pieces of event data information are transferred to the musical data memory 315. When all of the event registers are cleared, the answer in the decision step 710 is given in the negative, so that the central processing unit 318 proceeds to step 711 to add binary value "1" to the address data information (ADR), then returning to step 602 of the main routine program.

Figure 10:
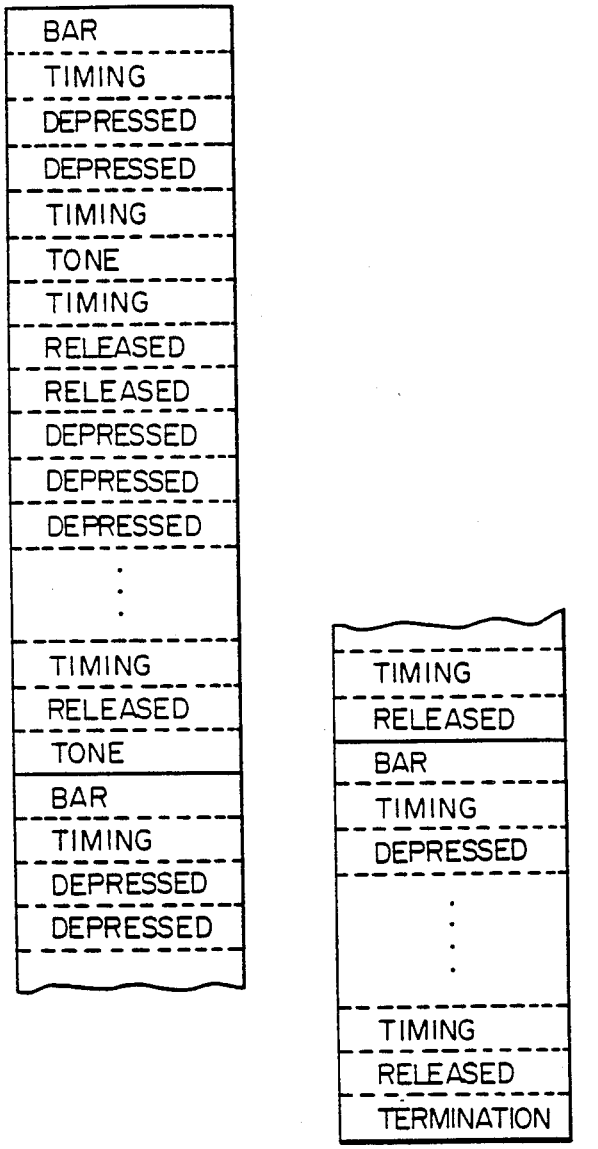
FIG. 10 is a view showing a sequence of the pieces of musical data information stored in the musical data memory incorporated in the electronic keyboard system shown in FIG. 1.

In this manner, all of the pieces of event data information produced upon keying-in operations or actuation of the manipulating switch 413 or 414 are memorized in the musical data memory 315 during the recording mode of operation. A sequence of the pieces of musical data information stored in the musical data memory 315 is illustrated in FIG. 10 by way of example, and the bar head position data information, the timing data information, the depressed-key data information, the released-key data information and the tone color and effect data information are represented by individual words "BAR", "TIMING", "DEPRESSED", "RELEASED" and "TONE", respectively. As will be understood from FIG. 10, the pieces of event data information simultaneously occurred are grouped and memorized into a series of memory locations contiguous to the timing data information.

When the player wants to terminate the recording mode of operation, the manipulating switch 402 will be depressed. The depression of the manipulating switch 402 is detected by the central processing unit 318 in step 602 of the main routine program and recognized in step 603. Then, the control is branched to the rhythm termination sub-routine program shown in FIG. 8. In the rhythm termination sub-routine program, the rhythm run flag information (RUN) is set to binary number "0" in step 1002, so that the percussive sound source 311 terminates the production of the percussive sound signal. Then, no percussive sound is produced by the sound system 304. After changing the rhythm run flag information (RUN) into binary value "0", the central processing unit 318 proceeds to step 1003 to check into the working memory 319 to see if the auto-play write flag information (APW) is set to binary number "1". In the recording mode of operation, the auto-play write flag information (APW) has been set to binary number "1" on the basis of the actuation of the manipulating switch 406, so that the answer in the decision step 1003 is given in the positive. Then, the central processing unit 318 transfers the terminational position data information to the musical data memory 315 for writing into the memory location APM(ADR) as by step 1006. For this reason, the sequence of the pieces of musical data information shown in FIG. 10 terminates with the terminational position data information which is represented by a word "TERMINATION". Subsequently, the central processing unit 318 sets the address data information (ADR) and the bar count data information "BACNT" into binary numbers "0" and "1", respectively, as by step 1007 and, then, proceeds to step 1008 to check into the musical data memory 315 to see whether or not the data information stored in the memory location APM(ADR=0) is of the bar head position data information. The memory location APM-(ADR=0) was caused to store the bar head position data information in step 1102 of the auto-play write sub-routine program shown in FIG. 9, so that the answer in the decision step 1008 is given in the positive. Then, the central processing unit 318 proceeds to step 1009 to add binary value "1" to the address data information (ADR). This incremented address data information specifies the memory location where the timing data information is stored for the first bar of the score, so that the central processing unit 318 transfers the incremented address data information to the memory location ADTBL of the address table 316 specified by the bar count data information of "1". The memory location of the address table 316 specified by the bar count data information (BACNT) is hereinunder represented by ADTBL(BACNT). The central processing unit 318 proceeds to step 1010 to add binary number "1" to the bar count data information (BACNT) and, then, increases the address information (ADR) by binary value "1" as by step 1011. With the incremented address information, the central processing unit checks into the musical data memory 315 to see if the memory location APM(ADR) stores the terminational position data information. In the example shown in FIG. 10, the second memory location stores the timing data information, so that the answer in the decision step 1012 is given in the negative. With the negative answer, the central processing unit 318 returns to step 1008 to see if the data information indicates the head position of the bar. Thus, the central processing unit 318 reiterates the loop consisting of steps 1008 to 1012 to pick up the memory locations each storing the timing data information next to the bar head position data information. When the answer in the decision step 1012 is given in the positive, the address table 316 is completed, so that the central processing unit 318 proceeds to step 1013 to set the auto-play write flag information (APW) into binary number "0". After setting the auto-play write flag information (APW) into binary number "0", no event data information is written into the musical data memory 315 because the answer in the decision step 704 of the usual sound producing sub-routine is given into the negative at all times. Subsequently, the central processing unit 318 checks the working memory 319 to see if the auto-play read flag information (APR) has binary value "1". In the recording mode of operation, the auto-play read flag information (APR) has binary value "0", so that the control exits from the rhythm termination sub-routine program to the main routine program with the negative answer for the decision step 1004.

Playback mode of operation

After completion of the recording mode of operation, the electronic keyboard system can be shifted into the playback mode of operation. The playback mode of operation starts with the manipulating-switch actuating event occurred by depressing the manipulating switch 407 and is, on the contrary, terminated by the terminational position data information or a depression of the manipulating switch 402.

Figure 11:
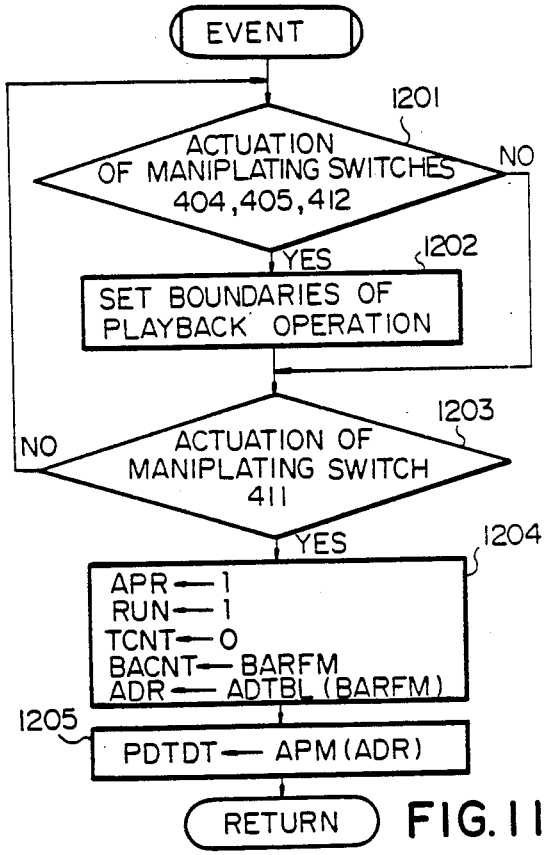
FIG. 11 a flowchart showing an auto-play read sub-routine program executed by the central processing unit in the playback mode of operation.

When the central processing unit 318 detects the manipulating switch actuating event in step 602 and, thereafter, recognizes the actuation of the switch 407 for shifting the control into the playback mode of operation in step 603 during an execution of the main routine program, the control is branched to an auto-play read sub-routine program shown in FIG. 11, and the auto-play sub-routine program starts with step 1201 where the central processing unit 318 checks to see if one of the manipulating switches 404, 405 and 412 is operated by the player. If there is found that no manipulating switch is operated, the central processing unit 318 proceeds to step 1203 without execution of step 1202 to see whether or not the manipulating switch 411 is operated by the player as by step 1203. If the answer in the decision step 1203 is given in the negative, the central processing unit 318 returns to step 1201, and reiterates the loop consisting of step 1201 and 1203. However, if the answer in the decision step 1201 is given in the positive, the central processing unit 318 activates the display control circuit 308 for allowing the player to check the instructions given by the operation of the manipulating switches. Namely, when the player depresses the manipulating switch 404, the display control circuit 308 allows the display window 415 to indicate the word "BARFM" which prompts the player to enter a starting position of the playback operation in terms of bar. On the other hand, if the manipulating switch 405 is operated, the display window 415 shows the word "BARTO" for prompting the player to enter a terminational position of the playback operation in terms of bar. With the prompt of "BARFM", the player selectively operates the ten-keys of the manipulating switches 412, and the starting position is set to the bar specified by the operation of the manipulating switches 412. The starting position is displayed on the window 415 for acknowledgment. Similarly, when the player operates the manipulating switches 412 after indication of the prompt of "BARTO", the boundary is set to the terminational position in accordance with the manipulating switches thus operated. The terminational boundary is also displayed on the window 415 for acknowledgment. After each setting operation, when the central processing unit 318 recognizes the operation of the manipulating switch 411 in step 1203, the data information representative of the boundary for the playback operation is transferred to the working memory 319 for storing the data information as the starting bar data information (BARFM) or the terminational bar data information (BARTO). Then, the central processing unit 318 proceeds to step 1204 to set the auto-play read flag information (APR), the rhythm run flag information (RUN) and the tempo count data information (TCNT) to the initial values of "1", "1" and "0", respectively. In step 1204, the central processing unit 318 further sets the bar count data information (BACNT) to the value identical with the starting bar data information (BARFM), and the address data information (ADR) is given the value stored in the memory location (ADTBL) (BARFM)) of the address table 316. Then, the central processing unit 318 will start the playback operation from the musical data information contiguous to the timing data information in the memory location indicated by the address data information (ADR). After executing all of the instructions related to step 1204, the central processing unit 318 proceeds to step 1205 to transfer the timing data information in the memory location (APM(ADR)) of the musical data memory 315 to the working memory as the readout timing data information (RDTDT). After completion of step 1205, the central processing unit 318 returns to 602 of the main routine program.

In the main routine program, the central processing unit 318 reiterates the loop consisting of steps 602 and 603 and executes the usual sound producing sub-routine program upon detection of the key-on event, the manipulating-switch actuating event or the key-off event as described hereinbefore. However, if the tempo clock signal is applied to the central processing unit 318, the control is branched to the rhythm production sub-routine program, so that the central processing unit 318 reiterates the loop consisting of steps 801 to 807 for producing the percussive sounds. In the loop consisting of steps 801 to 807, the central processing unit 318 checks into the working memory 319 to see if the auto-play read flag information (APR) is set to binary number "1". In the playback mode of operation, the auto-play read flag information (APR) was set to binary number "1" at step 1204 of the auto-play read sub-routine program, so that the answer for the decision step 803 is given in the positive at all times. Then, the central processing unit 318 proceeds to step 900 to execute the musical data information reading out sub-routine program shown in FIG. 7.

Musical data information reading out sub-routine

Assuming now that the pieces of musical data information are stored in the musical data memory 315 as shown in FIG. 10, the musical data information reading out sub-routine program starts with step 901 followed by step 902 in which the central processing unit 318 checks the working memory 319 to see if the read-out timing data information (RDTDT) is equal in value to the tempo count data information (TCNT). If the answer in the decision step 902 is given in the negative, the central processing unit returns to the step 804 of the rhythm production sub-routine program without executing steps 903 to 912. However, the tempo count data information (TCNT) is incremented by the tempo clock signal, then the answer in the decision step 902 becomes to be positive. The central processing unit 318 adds binary value "1" to the address data information (ADR) as by step 903, and, then, proceeds to step 904 to read out the data information from the memory location (APM(ADR)) for transferring the data information to the working memory 319 as the read-out data information (RDDT). The central processing unit 318 then checks to see whether or not the read-out data information (RDDT) is one of the pieces of timing data information stored in the musical data memory 315 as by step 905. Since, the address information (ADR) was set to the value stored in the memory location (ADTBL-(BARFM)) of the address table 316 in step 1204 of the auto-play read sub-routine program, the data information was read out from the memory location next to the bar head position data information at step 904. Then, the timing data information is stored as the read-out data information, and, for this reason, the answer for the decision step 905 is given in the positive in the first execution. With the positive answer for the decision step 905, the central processing unit 318 proceeds to step 906 to transfer the read-out data information to the working memory 319 as the read-out timing data information (RDTDT). After step 906, the central processing unit 318 returns to the rhythm production sub-routine program. However, the address data information (ADR) is incremented in step 903 with time, so that the answer for the decision step 905 will be given in the negative. Then, the central processing unit 318 proceeds to step 907 to check into the musical data memory 315 to see if the read-out data information (RDDT) is of the terminational position data information (TERMI- NATION). In the second execution, the answer for the decision step 907 is given in the negative, so that the central processing unit 318 proceeds to step 908. In step 908, the central processing unit 318 checks to see whether or not the read-out data information (RDDT) is of the bar head position data information. The answer in the decision step 908 is given in the negative on the assumption described above, then the central processing unit 318 transfers the read-out data information to the second tone signal generating circuit 313 as by step 909, because the read-out data information is one of the depressed-key data information, the released-key data information and the tone color and effect data information. With the read-out data information, the second tone signal generating circuit 313 produces the tone signal which in turn is supplied to the sound system 304. When the transferring is completed, the central processing unit 318 returns to step 903 so as to increment the address data information (ADR). Thus, the central processing unit 318 reiterates the loop consisting of steps 903 to 909 until the answer for the decision step 908 is given in the positive. When all of the pieces of data information related to the first bar have been read out from the musical data memory 315 and, then, transferred to the second tone signal generating circuit 313, the answer for the decision step 908 is changed from negative to positive, so that the central processing unit 318 proceeds to step 910 to add binary number "1" to the bar count data information (BACNT). Subsequently, the central processing unit 318 compares the bar count data information (BACNT) with the terminational bar data information (BARTO) as by step 911. If there is found that the bar count data information (BACNT) is not greater than the terminational bar data information (BARTO), the answer in the decision step 911 is given in the negative. Then, the central processing unit 318 returns to step 903 and continues to reiterate the loop consisting of steps 903 to 911. In this manner, the pieces of musical data information stored in the memory 315 are successively read out and transferred to the second tone signal generating circuit 313 for reproducing the musical tones. Finally, when the last data information is red out from the memory 315, the answer for the decision step 907 is given in the positive. The central processing unit 318 proceeds to step 912 to set the auto-play read flag information (APR) and the rhythm run flag information (RUN) to binary number "0" and, thereafter, returns to the rhythm production sub-routine program. As described above, the rhythm run flag information (RUN) has binary value "0", then the central processing unit 318 immediately returns to step 602 of the main routine program without executing steps 802 to 809 even if the interrupt is occurred upon application of the tempo clock signal. This means that no percussive sound signal and, accordingly, no percussive sound are produced. The central processing unit 318 does not execute the musical data information reading-out sub-routine program, so that no tone signal and, accordingly, no musical tone are produced, thereby terminating the playback mode of operation.

If the player wants to intentionally terminate the playback operation, the manipulating switch 402 is depressed by the player. Then, the central processing unit 318 detects the manipulating-switch actuating event at step 603 and, then, identifies that the manipulating switch 402 is depressed as by step 604. As the result of the execution of step 604, the control is branched to the rhythm termination sub-routine program shown in FIG. 8. In the rhythm termination sub-routine program, the central processing unit 318 sets the rhythm run flag information (RUN) to binary number "0" and, then, proceeds to step 1003. In the playback mode of operation, the auto-play write flag information (APW) has been set to binary number "0", so that the central processing unit 318 further proceeds to step 1004 to check into the working memory 319 to see if the auto-play read flag information (APR) has been set to binary number "1". The auto-play read flag information was set to binary number "1" in step 1204 of the auto-play read sub-routine program, so that the answer for the decision step 1004 is given in the positive. Then, the central processing unit 1004 proceeds to step 1005 to set the auto-play read flag information (APR) to binary number "0" and, thereafter, returns to the main routine program. Thus, the rhythm run flag information (RUN) is set to the binary number "0" in step 1005, so that the central processing unit 318 immediately returns to the main routine program upon the interrupt occurred upon application of the tempo clock signal. As a result, no percussive sound and no musical tone is produced in the sound system 304 as similar to the termination caused by the completion of the playback operation.

Editing mode of operation

Description is hereinunder made for the editing mode of operation.

(A) Timing editing operation

Figure 13:
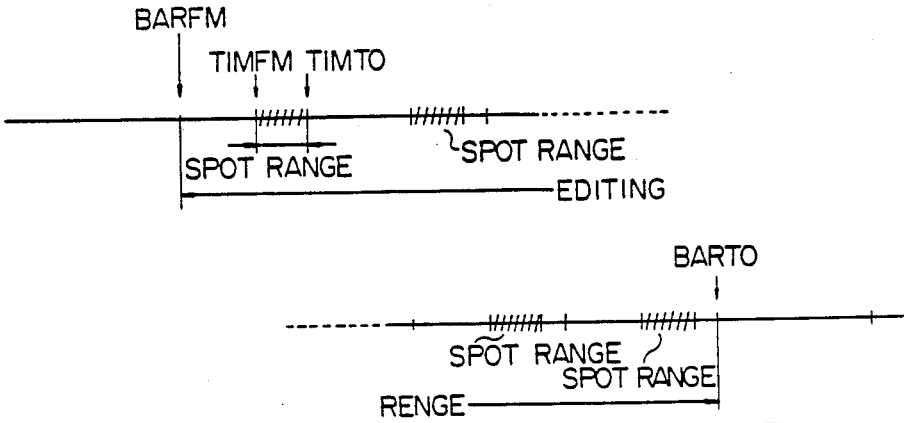
FIG. 13 is a diagram showing the relationship between an editing range and a spot range established in the editing mode of operation.

If the player wants to enter the timing editing operation, the manipulating switch 408 is depressed. Then, the control is branched to a timing editing sub-routine program 1400 which is described in detail with reference to FIGS. 12A and 12B. The timing editing sub-routine program 1400 starts with step 1401, and the central processing unit 318 checks into the working memory 319 to see if any one of the manipulating switches 404, 405 and 412 is operated by the player. If there is no manipulating switch operated by the player, the answer in the decision step 1401 is given in the negative, so that the central processing unit 318 proceeds to step 1403 without executing step 1402. In step 1403, the central processing unit 318 further checks the working memory 319 to see if the manipulating switch 411 is operated by the player. If the answer in the decision step 1403 is given in the negative, the central processing unit 318 returns to step 1401 and, then, reiterates the loop consisting of steps 1401 and 1403. When the central processing unit 318 finds that one of the manipulating switches 404, 405 and 412 is operated by the player, the central processing unit 318 focuses the setting operation upon one of the pieces of data information (BARFM), (BARTO), (TIMFM), (TIMTO) and (dTIME) with guidances or prompts displayed on the window 415 and temporally stores the value specified by the manipulating switches so as to define an editing range and a spot range and set the modificatory timing data information (dTIME) as by step 1402. As illustrated in FIG. 13, the editing range is defined by the starting bar data information (BARFM) and the terminational bar data information (BARTO), and the spot range is defined by the starting timing data information (TIMFM) and the terminational timing data information (TIMTO). As will be seen from FIG. 13, the spot range is nested in the editing range, and a modification of the pieces of musical data information is carried out for the pieces of musical data information within the spot range. In detail, if the manipulating switch 404 is repeatedly operated by the player, the display controller 308 causes the window 415 to change a word displayed thereon to "BARFM", then a word "BARTO", then a word "TIMFM", then a word "TIMTO", then "dTIME". However, if the manipulating switch 405 is repeatedly depressed, the display window 415 successively indicates the words in the opposite direction. The display window 415 thus prompts the player to enter a value for the data information displayed thereon, so that the player set the data information to a value by using the tenkey switches of the manipulating switches 412. The sign keys are used for setting the modificatory timing data information (dTIME) to a positive value or a negative value. The value specified by the player is also displayed on the window 415 for acknowledgment, and the central processing unit 318 proceeds to step 1403 to see if the manipulating switch 411 is operated. If there is found that the switch 411 is depressed, the data information is transferred to the working memory 319 for storage as by step 1404.

In step 1404, the central processing unit 318 further sets the bar count data information (BACNT) to the identical value of the starting bar data information (BARFM), and the address data information stored in the address table specified by ADTBL(BARFM) is transferred to the working memory 319 for storing as the address information (ADR). Subsequently, the central processing unit 318 proceeds to step 1405 to read out the musical data information from the memory location specified by APM(ADR) as the read-out data information (RDDT) as by step 1405. The read-out data information (RDDT) thus read out from the musical data memory 315 is checked to see if the read-out data information is of the timing data information as by step 1406. As described hereinbefore, the address table is provided to store a series of memory locations each storing the timing data information, then the first read-out data information is of the timing data information. This results in that the answer in the decision step 1406 is given in the positive. Then, the central processing unit 318 proceeds to step 1407 and, thereafter, 1408 to see if the read-out data information (RDDT) is located in the spot range. Namely, the read-out data information (RDDT) is compared with the starting timing data information (TIMFM) to see if the read-out data information (RDDT) is less in value than the terminational timing data information (TIMTO) as by step 1407. Subsequently, the read-out data information (RDDT) is compared with the starting timing data information (TIMFM) to see If the read-out data information (RDDT) is greater in value than or equal in value to the starting timing data information (TIMFM). If there is found that the read-out data information is located within the spot range, both answers are given in the positive, respectively. Then, the central processing unit 318 proceeds to step 1409 where the modificatory timing data information (dTIME) is added to the lapse of time contained in the read-out data information, which is of the timing data information, for modification, and, then, modified timing data information is transferred to the musical data memory 315 for storing it into the memory location (APM(ADR)) where the timing data information was originally stred. After modification of the timing data information, the central processing unit 318 proceeds to step 1410 to add binary value "1" to the address data information (ADR). When the address information (ADR) is incremented, the central processing unit 318 returns to step 1405 to read out a piece of new data information from the musical data memory 315. However, if the answer for either step 1407 or 1408 is given in the negative, the timing data information read out from the musical data memory 315 is out of the spot range. Then, the central processing unit 318 proceeds to step 1410 without executing steps 1409. This means that no modification is carried out for the timing data information read out from the memory 315. On the other hand, if the answer for the decision step 1406 is given in the negative, the central processing unit 318 proceeds to step 1411 to see if the read-out data information is of the terminational position data information. If there is found that the read-out data information is of the terminational position data information, the central processing unit 318 returns to step 602 of the main routine program without executing steps 1412 to 1414. However, if the answer for the decision step 1411 is given in the negative, the central processing unit proceeds to step 1412 to see if the read-out data information is of the bar head position data information. When the answer for the decision step 1412 is given in the negative, the central processing unit 318 proceeds step 1410 to increment the address data information (ADR). On the other hand, the answer in the decision step 1412 is given in the positive, the central processing unit 318 adds binary value "1" to the bar count data information (BACNT) as by step 1413. Subsequently, the bar count data information (BARCNT) is compared with the terminational bar data information (BARTO) to see if the bar count data information (BACNT) is greater in value than the terminational bar data information (BARTO). In the case where the answer is given in the negative, the read-out data information is located in the editing range, then the central processing unit 318 proceeds to step 1410 to increment the address data information. On the other hand, when the bar count data information (BACNT) is greater in value than the terminational bar data information (BARTO), the read-out data information is out of the editing range, then the central processing unit 318 returns to step 602 of the main routine program. For this reason, the read-out data information except for the timing data information receives no modification in the timing editing operation. In this manner, the lapse of time of the pieces of timing data information in the spot range is modified over the editing range on the basis of the modificatory timing data information (dTIME) which was set to an arbitrary value in the initial stage of the editing operation. In the timing editing operation, the player can uniformly change the producing timing of the musical tones from the bar head position specified by the player, so that the timing editing operation is convenient to change the impression of the music. Additionally, if the terminational position data information is read out from the musical data memory 315 before the terminational bar data information (BARTO) due to mis-setting operation, the central processing unit 318 finds the terminational position data information in step 1411, then returning to step 602 of the main routine program. Then, no trouble takes place due to the mis-setting operation.

(E) Touch-editing operation

Figure 14A:
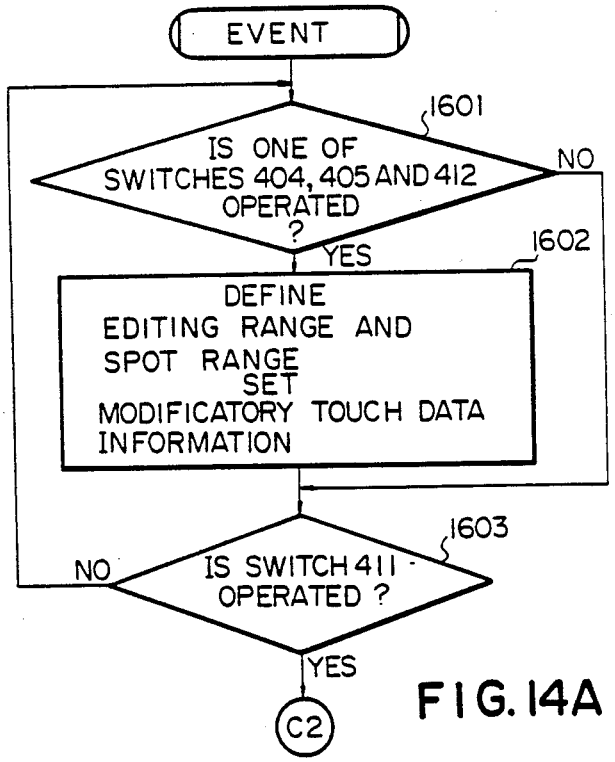
FIGS. 14A and 14B are flowcharts showing a touch-editing sub-routine program executed by the central processing unit in the editing mode of operation.
Figure 14B:
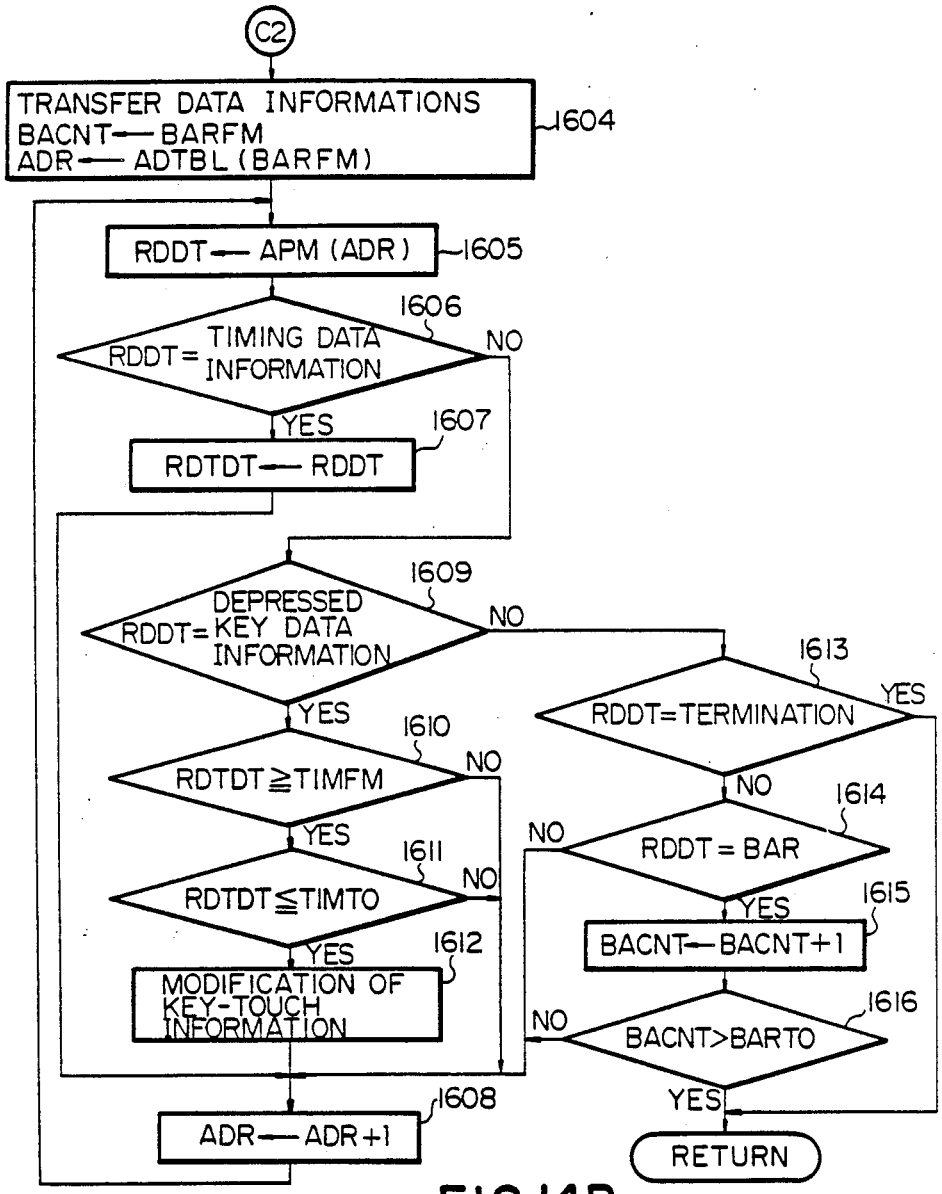

A sequence of the touch-editing operation is shown in FIGS. 14A and 14B. If the central processing unit 318 detects the depression of the manipulating switch 409, the control is branched to the touch-editing sub-routine program 1600. The touch-editing sub-routine program starts with step 1601 where the central processing unit 318 checks into the working memory 319 to see if any one of the manipulating switches 404, 405 and 412 is operated by the player. If there is no manipulating switch operated by the player, the answer in the decision step 1601 is given in the negative, so that the central processing unit 318 proceeds to step 1603 without executing step 1602. In step 1603, the central processing unit 318 further checks the working memory 319 to see if the manipulating switch 411 is operated by the player. If the answer in the decision step 1603 is given in the negative, the central processing unit 318 returns to step 1601 and, then, reiterates the loop consisting of steps 1601 and 1603. When the central processing unit 318 finds that one of the manipulating switches 404, 405 and 412 is operated by the player, the central processing unit 318 focuses the setting operation upon one of the pieces of data information (BARFM), (BARTO), (TIMFM), (TIMTO) (TIMTO) and (dKTD) with guidances or prompts displayed on the window 415 and, then, temporally stores the data information so as to define an editing range and a spot range and set the modificatory touch data information (dKTD) as by step 1602. As similar to the timing editing operation, the editing range is defined by the starting bar data information (BARFM) and the terminational bar data information (BARTO), and the spot range is defined by the starting timing data information (TIMFM) and the terminational timing data information (TIMTO). When the player completes the setting operation, the manipulating switch 411 is depressed by the player, then the central processing unit 318 proceeds step 1604 to transfer the pieces of data information (BARFM), (BARTO), (TIMFM), (TIMTO) and (dKTD) to the working memory 319.

In step 1604, the central processing unit 318 further sets the bar count data information (BACNT) to the identical value of the starting bar data information (BARFM), and the address data information stored in the address table specified by ADTBL(BARFM) is transferred to the working memory 319 for storing as the address information (ADR). Subsequently, the central processing unit 318 proceeds to step 1605 to read out the musical data information from the memory location specified by APM(ADR) as the read-out data information (RDDT). The read-out data information (RDDT) thus read out from the musical data memory 315 is checked to see if the read-out data information is of the timing data information as by step 1606. As described hereinbefore, the address table is provided to store a series of memory locations each storing the timing data information, then the first read-out data information must be of the timing data information. This results in that the answer in the decision step 1606 is given in the positive. Then, the central processing unit 318 proceeds to step 1607 to transfer the read-out data information (RDDT) to the working memory 319 as the read-out timing data information (RDTDT), then further proceeding step 1608. In step 1608, the address data information (ADR) is incremented by one, and, then, the central processing unit 318 returns to step 1605 for reading out a piece of new musical data information from the musical data memory 315.

If the answer for the decision step 1606 is given in the negative, the central processing unit 318 proceeds to step 1609 to see if the read-out data information is of the depressed-key data information. With the positive answer for the decision step 1609, the central processing unit 318 proceeds to step 1610 and, thereafter, step 1611 to see if the read-out timing data information (RDTDT) is located within the spot range. Namely, the central processing unit 318 checks to see if the read-out timing data information (RDTDT) is equal to or greater than the starting timing data information (TIMFM) in the decision step 1610 and further to see whether or not the read-out timing data information (RDTDT) is less than the terminational timing data information (TIMTO) in the decision step 1611. If the read-out timing data information (RDTDT) is out of the spot range, at least one of the answers for the decision steps 1610 and 1611 is given in the negative, then the central processing unit 318 returns to step 1608 without executing step 1612. On the other hand, the read-out timing data information (RDTDT) is within the spot range, each of the answers for the decision steps 1610 and 1611 is given in the positive, then the central processing unit 318 proceeds to step 1612 to modify the key-touch data information. In detail, the central processing unit 318 adds the modificatory touch data information (dKTD) to the key-touch data information forming part of the depressed-key data information and, then, rewrites the depressed-key data information with the modified key-touch data information to the original memory location. When the key-touch data information is modified, the central processing unit 318 returns to step 1608 to increment the address information (ADR). On the other hand, if there is found that the read-out data information is different from the depressed-key data information, the central processing unit 318 proceeds to step 1613 to see if the read-out data information is of the terminational position data information. If the answer in the decision step 1613 is given in the positive, all of the pieces of data information have been read out from the musical data memory 315, so that the central processing unit 318 returns to step 602 of the main routine program without executing steps 1614 to 1616. However, if the answer for the decision step 1613 is given in the negative, the central processing unit proceeds to step 1614 to see if the read-out data information is of the bar head position data information. When the answer for the decision step 1614 is given in the negative, the central processing unit 318 proceeds step 1608 to increment the address data information (ADR). On the other hand, the answer in the decision step 1614 is given in the positive, the central processing unit 318 adds binary value "1" to the bar count data information (BACNT) as by step 1615. Subsequently, the bar count data information (BARCNT) is compared with the terminational bar data information (BARTO) to see if the bar count data information (BACNT) is greater in value than the terminational bar data information (BARTO). In the case where the answer is given in the negative, the read-out data is located in the editing range, then the central processing unit 318 proceeds to step 1608 to increment the address data information (ADR). On the other hand, when the bar count data information (BACNT) is greater in value than the terminational bar data information (BARTO), the read-out data information is out of the editing range, then the central processing unit 318 returns to step 602 of the main routine program. This results in that the read-out data information except for the key-touch information of the depressed-key data information receives no modification in the touch editing operation.

Thus, the key-touch information is uniformly modified in the touch editing operation, so that the musical tones reproduced in the playback mode of operation are increased or decreased in loudness as if the player performs the same music with a different key-touch. The pieces of key-touch information in the spot range are automatically modified over the editing range on the basis of the modificatory touch data information which was set to an arbitrary value in the initial stage of the editing operation. This results in easy for modification. Additionally, if the terminational position data information is read out from the musical data memory 315 before the terminational bar data information (BARTO) due to mis-setting operation, the central processing unit 318 finds the terminational position data information at step 1411, then returning to step 602 of the main routine program. Then, no trouble takes place due to the misset-ting operation.

(C) Separate-editing operation

Figure 15A:
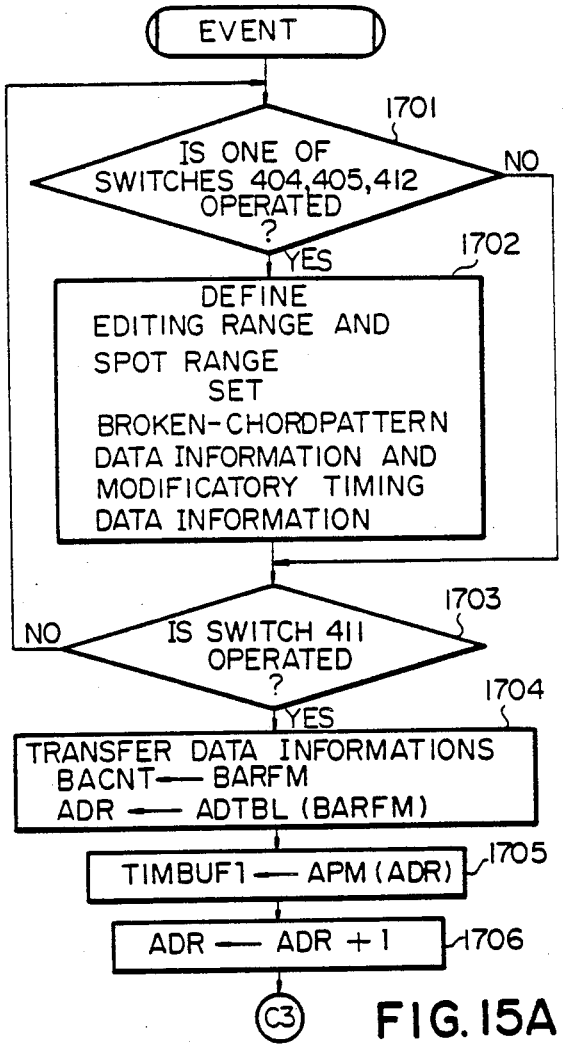
FIGS. 15A and 15B are flowcharts showing a separate-editing sub-routine program executed by the central processing unit in the editing mode of operation.
Figure 15B:
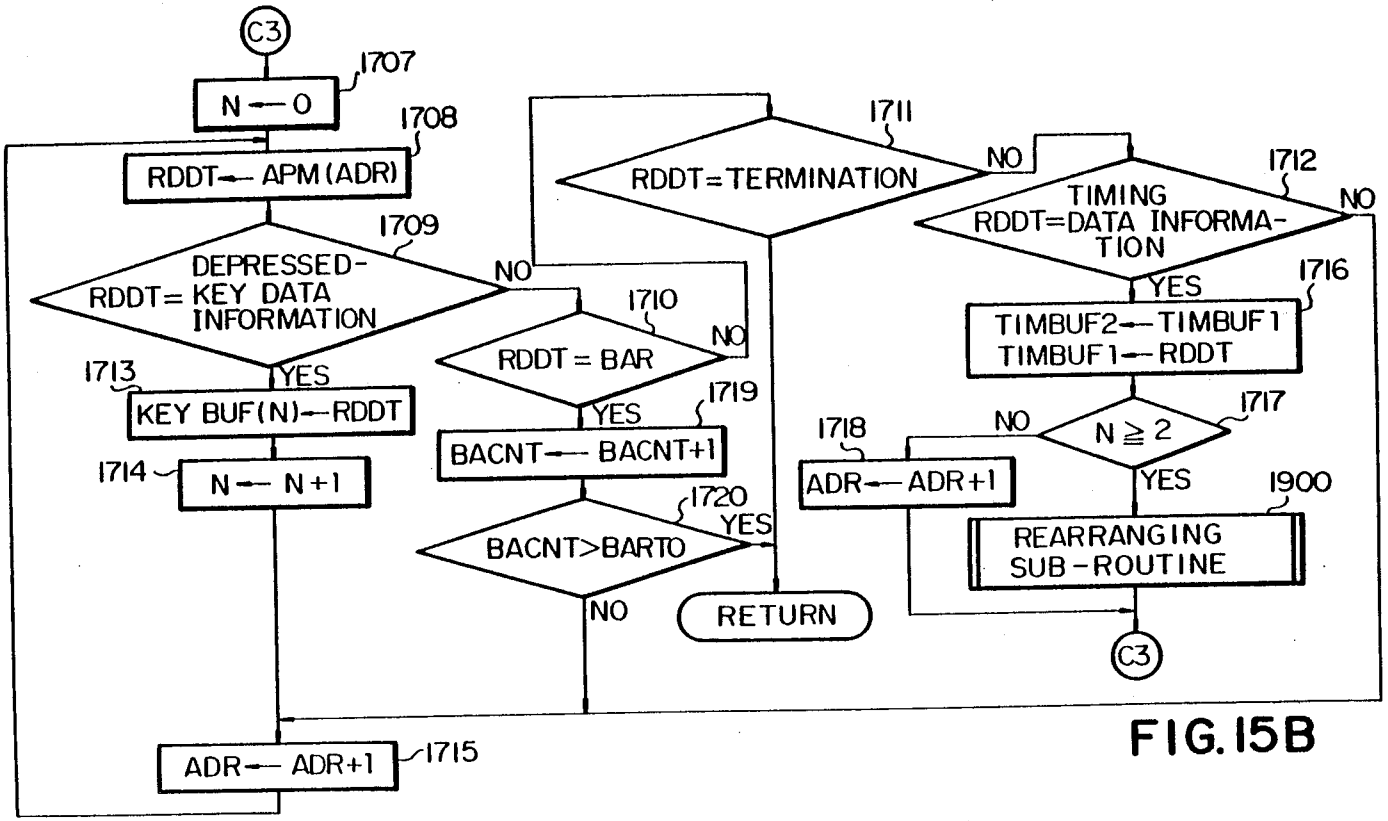

A sequence of the separate-editing operation is shown in FIGS. 15A and 15B. Description is hereinunder made for the separate-editing operation on the assumption that a chord 1800 is broken in the manner illustrated in FIG. 16. If the central processing unit 318 detects the depression of the manipulating switch 410, the control is branched to the separate-editing sub-routine program 1700. The separate-editing sub-routine program 1700 starts with step 1701 where the central processing unit 318 checks to see if any one of the manipulating switches 404, 405 and 412 is operated by the player. If there is no manipulating switch operated by the player, the answer in the decision step 1701 is given in the negative, so that the central processing unit 318 proceeds to step 1703 without executing step 1702. In step 1703, the central processing unit 318 further checks to see if the manipulating switch 411 is operated by the player. If the answer in the decision step 1703 is given in the negative, the central processing unit 318 returns to step 1701 and, then, reiterates the loop consisting of steps 1701 and 1703.

When the central processing unit 318 finds that one of the manipulating switches 404, 405 and 412 is operated by the player, the central processing unit 318 focuses the setting operation upon one of the pieces of data information (BARFM), (BARTO), (TIMFM), (TIMTO), (STYP) and (dTIME) with guidances or prompts displayed on the window 415 and, then, temporally stores the data information so as to define an editing range and a spot range and set the broken-chord pattern data information and the modificatory timing data information as by step 1702. As similar to the timing editing operation, the editing range is defined by the starting bar data information (BARFM) and the terminational bar data information (BARTO), and the spot range is defined by the starting timing data information (TIMFM) and the terminational timing data information (TIMTO). In this instance, numeral keys (0) and (1) are used for selection of the broken-chord pattern. When the player completes the setting operation, the manipulating switch 411 is depressed by the player, then the central processing unit 318 proceeds step 1704 to transfer the pieces of data informations (BARFM), (BARTO), (TIMFM), (TIMTO), (STYP) and (dKTD) to the working memory 319 for storage.

In step 1704, the central processing unit 318 further sets the bar count data information (BACNT) to the identical value of the starting bar data information (BARFM), and the address information stored in the address table specified by ADTBL(BARFM) is transferred to the working memory 319 for storing as the address information (ADR). Subsequently, the central processing unit 318 proceeds to step 1705 to read out the musical data information from the memory location specified by APM(ADR) as the first timing buffer data information (TIMBUF1). Then, the address data information (ADR) is incremented by one as by step 1706, and the central processing unit 318 then proceeds to step 1707 to set the count data information (N) to zero as by step 1707. In the next step 1708, the central processing unit 318 accesses the working memory 319 to read out the musical data information stored in the memory location specified by APM(ADR) as the read-out data information (RDDT). The read-out data information (RDDT) thus read out from the musical data memory 315 is checked to see if the read-out data information is of the depressed-key data information as by step 1709. As described hereinbefore, the address table is provided to store a series of memory locations each storing the timing data information, then the first read-out data information must be of the timing data information. This results in that the answer in the decision step 1709 is given in the negative. Then, the central processing unit 318 sequentially executes decision steps 1710, 1711 and 1712. In the decision steps 1710, 1711 and 1712, the read-out data information (RDDT) is checked to see if it is of the bar head position data information (in the decision step 1710), of the terminational position data information (in the decision step 1711) or of the timing data information (in the decision step 1712): The first read-out data information (RDDT) is of the timing data information, so that the central processing unit returns from the decision step 1712 to step 1715 where the address information (ADR) is incremented by one, then returning to step 1708. Thus, the central processing unit reiterates the loop consisting of steps 1708 to 1715.

While the central processing unit 318 repeats the loop consisting of steps 1708 to 1715, the answer for the decision step 1709 is given in the positive, then the central processing unit 318 proceeds to step 1713 to transfer the read-out data information (RDDT) to the working memory 319 as the key buffer data information (KEYBUF(N)) where the count data information N) is currently zero. The central processing unit 318 proceeds to step 1714 to increment the count data information (N), and the address data information (ADR) is incremented by one in step 1715, then returning to step 1708. Thus, the central processing unit 318 reiterates the loop consisting of steps 1708, 1709, 1713, 1714 and 1715 to decide the number of the depressed-key data informations stored in series.

If a plurality of keys are simultaneously depressed to provide a chord, a series of pieces of depressed-key data information are stored between the two pieces of timing data information. One of the pieces of tone color and effect data information may intervene between the last depressed-key data information and the timing data information. As a result of the reiteration of the loop consisting of steps 1708, 1709, 1713, 1714 and 1715, each of the pieces of depressed-key data information has been temporally stored in the working memory 319, and the count data information (N) is set to be equal in number to the series of the pieces of depressed-key data information. When the tone color and effect data information or the timing data information contiguous to the series of the pieces of depressed-key data information is read out from the musical data memory 315, the answers in the respective decision steps 1709, 1710 and 1711 are given in the negatives, respectively. If the read-out data information (RDDT) is of the tone color and effect data information, the answer in the decision step 1712 is also given in the negative, then the central processing unit 318 proceeds to step 1715 where the address data information (ADR) is incremented by one. However, if the read-out data information (RDDT) is of the timing data information, the answer for the decision step 1712 is given in the positive. Then, the central processing unit 318 proceeds to step 1716 to transfer the first timing buffer data information to the next location for establishment of the second timing buffer data information (TIMBUF2) and, thereafter, the read-out data information (RDDT) is stored as the first timing buffer data information (TIMBUF1). After establishment of the first and second pieces of timing buffer data information, the central processing unit 318 proceeds to step 1717 to see if the count data information (N) is equal to or greater than decimal number "2". If the answer in the decision step 1717 is given in the negative, a piece of single depressed-key data information is merely read out from the musical data information, then the central processing unit 318 proceeds to step 1718 to increment the address data information (ADR). When the address data information (ADR) is incremented, the central processing unit 318 returns to step 1707 to clear the count data information (N) for continuation of the separate-edit sub-routine program. However, if there is found that the count data information (N) is equal to or greater than decimal number "2", the control is branched to a rearranging sub-routine program 1900 for separating the chord into a series of musical tones. A sequence of the rearranging sub-routine program is shown in FIGS. 17A and 17B, and description will be hereinunder made in detail.

When the read-out data information is of the bar head position data information, the answer for the decision step 1710 is given in the positive, so that the central processing unit 318 proceeds to step 1719 where the bar count data information (BACNT) is incremented by one. Then, the central processing unit 318 proceeds to step 1720 to see if the bar count data information (BACNT) is greater in value than the terminational bar data information (BARTO). If the answer in the decision step 1720 is given in the positive, the read-out data information is out of the editing range. Then, the central processing unit 318 completes the separate-editing operation and returns to step 602 of the main routine program. On the other hand, the answer for the decision step 1720 is given in the negative, the central processing unit 318 returns to step 1715 for continuation of the separate editing operation.

Rearranging sub-routine

Figure 16:
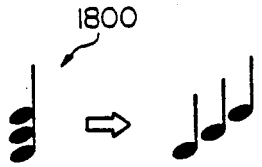
FIG. 16 is a view showing a series of notes rearranged from a chord.
Figure 18:
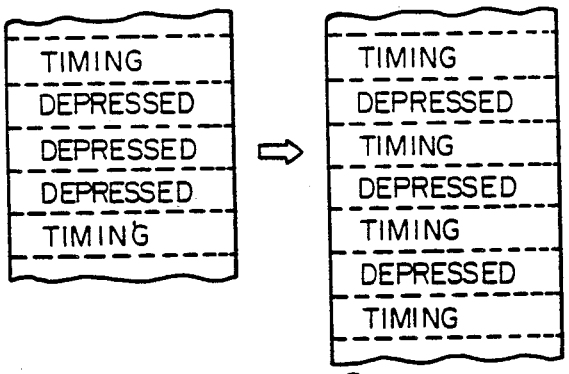
FIG. 18 is a view showing the pieces of musical data information rearranged during the separate-editing sub-routine program.
Figure 17A:
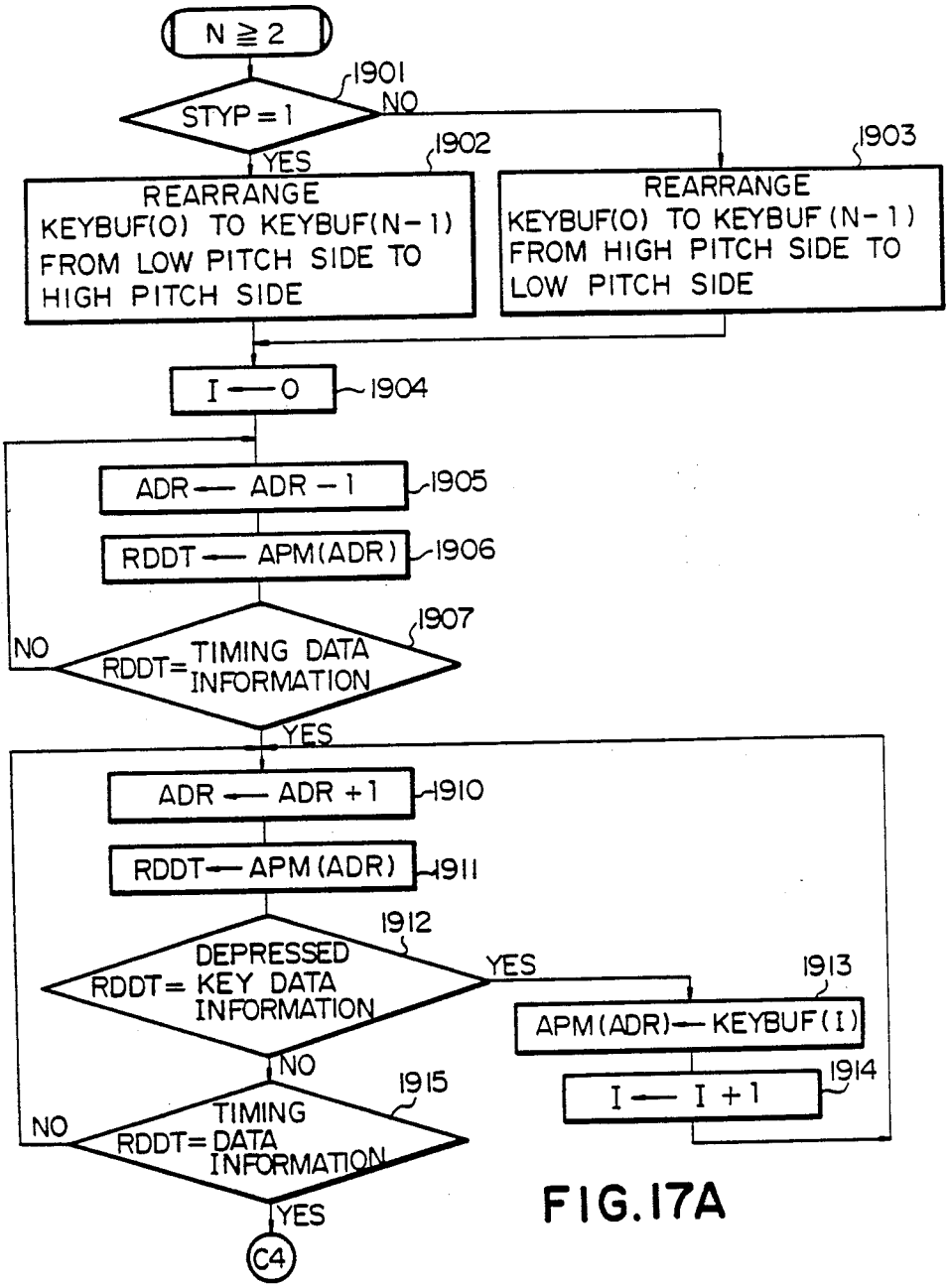
FIGS. 17A and 17B are flowcharts showing a rearranging sub-routine program nested in the separate-editing sub-routine program.
Figure 17B:
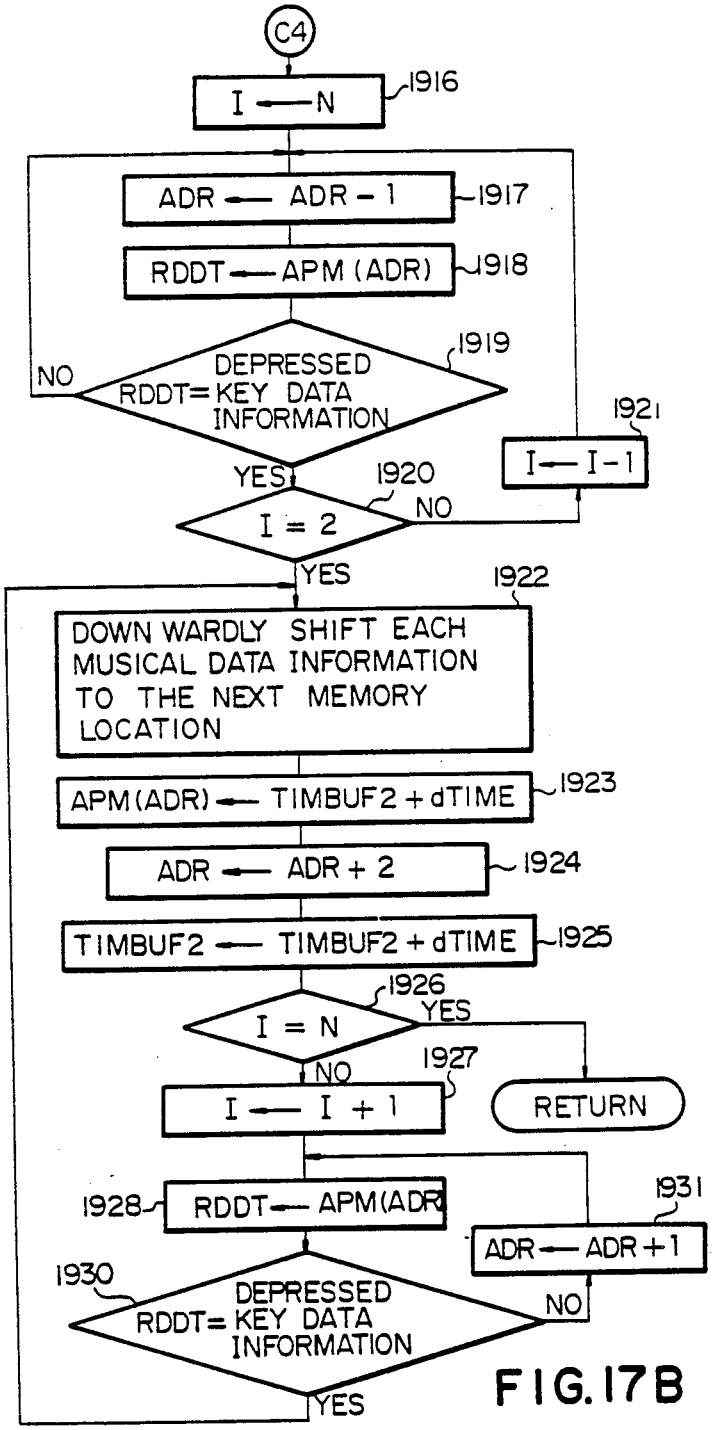

In step 1717 of the touch editing sub-routine program, if the central processing unit 318 finds that the count data information (N) is equal to or greater than decimal number "2", the control is branched to rearranging sub-routine program shown in FIGS. 17A and 17B. The rearranging sub-routine program starts with step 1901 where the central processing unit 318 checks to see if the broken-chord pattern data information (STYP) has been set to binary number "1". If there is found that the broken-chord pattern data information (STYP) is set to binary number "1", the central processing unit 318 proceeds to step 1902 to rearrange the pieces of key buffer data information (KEYBUF(0) to KEYBUF(N-1)) from the low pitch side to the high pitch side as shown in FIG. 16. On the other hand, if the answer for the decision step 1901 is given in the negative, the central processing unit 318 rearranges the pieces of key buffer data information (KEYBUF(0) to KEYBUF(N-1)) in the opposite direction to that in step 1902. When either step 1902 or 1903 is completed, the central processing unit 318 proceeds to step 1904 to set the index data information (I) to binary value "0". Then, the address data information (ADR) is decremented by one as by step 1905, and the musical data information specified by APM(ADR) is read out from the musical data memory 315 as the read-out data information (RDDT) as by step 1906. The central processing unit 318 then proceeds to step 1907 to see if the read-out data information (RDDT) is of the timing data information. If the answer in the decision step 1907 is given in the negative, the central processing unit 318 returns to step 1905 and reiterates the loop consisting of steps 1905 to 1907 until the answer for the decision step 1907 is changed to the positive. When the answer for the decision step 1907 is given in the positive, the address data information (ADR) designates the timing data information immediately before the pieces of depressed-key data information read out as the pieces of key buffer data informations. With the positive answer for the decision step 1907, the central processing unit 318 proceeds to step 1910 where the address data information (ADR) is incremented by one. Then, the musical data information stored in the memory location specified by APH(ADR) is read out as the read-out data information (RDDT) as by step 1911. The read-out data information (RDDT) is checked to see if it is of the depressed-key data information as by step 1912. If the answer in the decision step 1912 is given in the positive, the central processing unit 318 proceeds to step 1913 to transfer the key buffer data information represented by KEYBUF(I) to the memory location (APM(ADR)) of the musical data memory specified by the address data information (ADR). The index data information (I) is currently set to binary value "0", so that the key buffer data information (KEYBUF(0)) is transferred to the musical data memory 315. Then, the central processing unit proceeds to step 1914 where the index data information (I) is incremented by one, then returning to step 1910. In this manner, the central processing unit 318 reiterates the loop consisting of steps 1910 to 1914 for rearranging the pieces of depressed-key data information in the direction identical with that of the pieces of key buffer data information. When the answer for the decision step 1912 is given in the negative, all of the pieces of depressed-key data information are stored in the musical data memory 315 in the identical direction with the pieces of key buffer data information. With the negative answer for the decision step 1912, the read-out data information (RDDT) is checked to see if it is of the timing data information as by step 1915. If there is found that the read-out data information (RDDT) is not of the timing data information, the read-out data information may be of the tone color and effect data information followed by another depressed-key data information, so that the central processing unit 318 returns to step 1910 to continue the rearranging operation. However, if the answer for the decision step 1915 is given in the positive, the series of the pieces of depressed-key data information are rearranged to form a broken-chord, then central processing unit 318 proceeds to step 1916 where the index data information (I) is set to the value identical with the count data information (N) again. The index data information (I) is thus set to the initial value, then the central processing unit 318 proceeds to step 1917 where the address data information (ADR) is decremented by one. Using the decremented address data information (ADR), the central processing unit 318 reads out the musical data information from the memory location (APH(ADR)) as the read-out data information in step 1918. Then, the read-out data information is checked to see if it is of the depressed-key data information by as step 1919. When there is found that the answer in the decision step 1919 is given in the negative, the central processing unit 318 returns to step 1917 and reiterates the loop consisting of steps 1917 to 1919. While the central processing unit 318 executes the loop consisting of steps 1917 to 1919, the answer for the decision step 1919 is changed to the positive. The central processing unit 318 proceeds to step 1920 to see if the index data information (I) is equal to decimal number "2". When the answer in the decision step is given in the negative, the index data information (I) is decremented by one as by step 1921, the returning to step 1917. Thus, the central processing unit 318 reiterates the loop consisting of steps 1917 to 1921 until the index data information is equal to decimal number "2". If there is found that the index data information (I) is equal to decimal number "2", the address data information (ADR) designates the memory location of the musical data memory 315 where the second data information from the front depressed-key data information. In this situation, the answer for the decision step 1920 is given in the positive, then the central processing unit 318 proceeds to step 1922 where each piece of data information stored in the memory location (APM(ADR)) is downwardly shifted to the next memory location until the central processing unit 318 shifts the terminational position data information. The shifting operation is carried out without increment of the address data information (ADR), so that the address data information (ADR) continues to designate the memory location where the second depressed-key data information was stored. After completion of the shifting operation, the modificatory timing data information is added to the second timing buffer data information (TIMBUF2) and the modified timing buffer data information (TIMBUF2) is written into the memory location of the musical data memory 315 between the first and second pieces of depressed-key data informations. Thus, the second depressed-key data information is accompanied by the timing data information delayed by the modificatory timing data information (dTIME). The central processing unit 318 then proceeds to step 1924 where the address data information (ADR) is incremented by two, and, thereafter, the second timing buffer data information (TIMBUF2) is incremented by the value equal to the modificatory timing data information (dTIME) as by step 1925. Then, the central processing unit 318 proceeds to step 1926 where the index data information (I) is compared with the count data information (N) to see if the both pieces of data information are equal to each other. If the number of the pieces of depressed-key data information arranged in series is decimal number "2", the answer in the decision step 1926 is given in the positive, so that the central processing unit 318 completes the rearranging sub-routine program and returns to step 1707 of the separate-edit sub-routine program. However, if the pieces of depressed-key data informations arranged in series is greater in value than decimal number "2", the answer for the decision step 1926 is given in the negative, so that the index data information (I) is incremented by one as by step 1927. After increment of the index data information (I), the central processing unit reads out the musical data information from the memory location next to the second depressed-key data information as the read-out data information. Then, the read-out data information is checked to see if it is of the depressed-key data information as by step 1930. When the answer in the decision step 1930 is given in the negative, the central processing unit proceeds to step 1931 where the address data information (ADR) is incremented by one, then returning to step 1928. Thus, the central processing unit 318 reiterates the loop consisting of steps 1928 to 1931 until the third depressed-key data information is read out from the musical data memory 315. When the third depressed-key data information is read out, the answer for the decision step 1930 is given in the positive, so that the central processing unit 318 returns to step 1922. Thus, the central processing unit 318 reiterates the loop consisting of steps 1922 to 1931 to insert a modified timing data information between the two adjacent pieces of depressed-key data information as shown in FIG. 18. Each piece of modified timing buffer data information is greater in value than the previous modified timing buffer data information, so that each depressed-key data information causes the second tone generating circuit 313 to produce the musical tone delayed by the predetermined time period from the musical tone produced on the basis of the previous depressed-key data information. When all of the pieces of depressed-key data information arranged in series are accompanied by the pieces of modified timing buffer data informations, respectively, the index data information (I) becomes to be equal in value to the count data information (N), so that the central processing unit 318 finds that the answer for the decision step 1926 is given in the positive. Then, the central processing unit 318 returns to step 1707 of the rearranging sub-routine program. In the separate editing operation, the broken-chord is easily produced on the basis of the chord produced in the recording mode of operation.

Although particular embodiment of the present invention have been shown and described, it will be obvious to those skilled in the art that various changes and modifications may be made without departing from the spirit and scope of the present invention.

Namely, the editing mode of operation may be carried out for the key codes or the pieces of tone color and effect data information. In order to modify the key codes or the pieces of tone color and effect data information, it is necessary to provide a sub-routine program similar to the touch-editing sub-routine program. In the sub-routine program, spot ranges are established within an editing range and, then, the key codes or the pieces of tone color and effect data informations are modified in accordance with the key operations on the control board.

In another implementation, a plurality of second tone signal generating circuits are dedicated to the playback mode of operation, and each of the musical data informations has a tag information representative of the destination. In the editing mode of operation, if the pieces of tag informations is changed from one to another, a part of the music is simultaneously moved.

In the electronic keyboard instrument, the musical pieces of musical data information in each spot range are uniformly modified over the editing range in accordance with the instructions given by the player. However, still another implementation may have a player. However, still another implementation may have a manipulating switch for ignoring the instructions. If the manipulating switch is actuated during the editing mode of operation, the modification does not carry out for the pieces of musical data information for the bar specified by the manipulating switch. Then, the player can specify the bars in the score for the editing operations. In this implementation, the editing range may not be established.

The electronic keyboard instrument described above nests a spot range in a bar, however the spot range may be nested over a plurality of the bars. In order to nest the spot range in the arbitrary number of the bars, the loop consisting of steps 801 to 805 and 900 are repeated until the tempo count data information (TCNT) reaches the predetermined number indicating the completion over the arbitrary number of the bars. Moreover, the bar count data information (BACNT) is available for nesting the spot range over the plural bars.

In still another implementation, the editing range may be defined at the front boundary thereof by a combination of the starting bar data information and the starting timing data information and at the rear boundary thereof by a combination of the terminational bar data information and the terminational timing data information.

The electronic keyboard instrument described above breaks chords from the high-pitch side to the low pitch side or the opposite direction thereto. If each chord consists of musical tones more than two, the notes corresponding to the musical tones may be rearranged in a V-shape or the inverse thereof.

In the separate-editing mode of operation, the pieces of depressed-key data information simultaneously produced are separated from each other in such a manner that the two musical tones are sequentially produced with a time delay corresponding to the modificatory timing data information. However, in still another implementation, the pieces of depressed-key data information produced within an extremely short time period are deemed to be simultaneously produced. This results in easy for production of chord for a beginner. The extremely short time period may be set to a half of the modificatory timing data information (1/dTIME) or a quarter of the modificatory timing data information ( 1/TIME ). In order to enhance the operability of the electronic keyboard instrument, a series of pieces of depressed-key data information are memorized without the timing data information inserted therebetween if the pieces of depressed-key data information are produced within the extremely short time period. Moreover, the electronic keyboard instrument may equipped with an additional keyboard dedicated to the production of chords.

The electronic keyboard instrument may be equipped with a cassette tape reader or a floppy disk driver for reading out a series of musical data informations, and the pieces of musical data information thus read out are memorized in the musical data memory for the playback mode of operation or the editing mode of operation.

What is claimed is:

1. An electronic musical instrument operative to produce pieces of musical data information in a recording mode of operation while a player performs a music having a plurality of musical tones, said electronic musical instrument being further operative to reproduce the music tones on the basis of said pieces of musical data information in a playback mode of operation, said pieces of musical data information including at least one piece of timing data information representative of a lapse of time and pieces of note data information representative of a chord and associated with the timing data information, said pieces of note data information and said timing data information being produced upon detection of a plurality of keying-in operations concurrently carried out, comprising:

(a) memory means operative to memorize said pieces of musical data information in said recording mode of operation and to read out the pieces of musical data information in said playback mode of operation;

(b) checking means operative to check said memory means to find said piece of timing data information in said playback mode of operation, said piece of timing data information being read out in a nearly simultaneous timing;

(c) modifying means operative to produce a broken-chord on the basis of said pieces of note data information read out from said memory means when said checking means find said piece of timing data information; and (d) controlling means operative to cause said checking means to check said memory means for allowing said modifying means to produce said broken-chord.

2. An electronic musical instrument as set forth in claim 1, in which said modifying means produce other pieces of timing data information respectively representative of lapses of time different from one another, and in which said modifying means is further operative to insert said other pieces of timing data information into said pieces of note data information, respectively, so that the pieces of note data information are paired with said other pieces of timing data information, respectively.

3. An electronic musical instrument as set forth in claim 2, in which said modifying means produce said other pieces of timing data information and pair said other pieces of timing data information with said pieces of note data information, respectively, so as to reproduce said musical tones in a predetermined pitch order.

4. An electronic musical instrument as set forth in claim 3, in which said predetermined pitch order allows said musical tones to be reproduced from a high pitch side to a low pitch side with time.

5. An electronic musical instrument as set forth in claim 3, in which said predetermined pitch order allows said musical tones to be reproduced from a low pitch side to a high pitch side with time.

* * * * *